US009248897B2

(12) United States Patent
Shields

(10) Patent No.: US 9,248,897 B2
(45) Date of Patent: Feb. 2, 2016

(54) MOUNT AND CONTROL SYSTEM FOR AN ELECTRIC OUTBOARD

(71) Applicant: Michael Craig Shields, Sparks, NV (US)

(72) Inventor: Michael Craig Shields, Sparks, NV (US)

( * ) Notice: Subject to any disclaimer, the term of this patent is extended or adjusted under 35 U.S.C. 154(b) by 102 days.

(21) Appl. No.: 14/081,861

(22) Filed: Nov. 15, 2013

(65) Prior Publication Data

US 2015/0140877 A1 May 21, 2015

(51) Int. Cl.
*B63H 20/12* (2006.01)
*B63H 20/02* (2006.01)
*B63B 35/71* (2006.01)

(52) U.S. Cl.
CPC ..... *B63H 20/02* (2013.01); *B63B 35/71* (2013.01); *B63H 20/12* (2013.01)

(58) Field of Classification Search
CPC ..... B63H 21/17; B63H 20/007; B63H 20/02; B63H 20/08; B63H 20/12; B63H 20/16; B63H 21/26; B63H 21/265; Y02T 70/70; B63B 35/71
USPC ..... 440/6, 7; 114/114 R, 153, 160
See application file for complete search history.

(56) References Cited

U.S. PATENT DOCUMENTS

| | | | | |
|---|---|---|---|---|
| 2,627,833 A * | 2/1953 | Schroeder | 114/160 | |
| 2,654,335 A * | 10/1953 | Ball | 114/153 | |
| 2,749,872 A * | 6/1956 | Amick | B63H 21/265 | 114/153 |
| 4,348,193 A * | 9/1982 | Arndt | B63H 21/265 | 114/153 |
| 4,556,006 A * | 12/1985 | Kaupat | 114/162 | |
| 6,739,276 B1 * | 5/2004 | Rard | 114/347 | |
| 7,887,381 B2 * | 2/2011 | Brass et al. | 440/53 | |

* cited by examiner

*Primary Examiner* — Anthony Wiest
(74) *Attorney, Agent, or Firm* — Knobbe, Martens, Olson & Bear, LLP

(57) ABSTRACT

Systems and methods for mounting and controlling a motor on a kayak are disclosed. A motor may be mounted to a kayak by a single interface on the kayak and rotated using foot pegs. The control system provides for responsive input and automatic directional stabilization of the motor.

20 Claims, 31 Drawing Sheets

MOUNT AND CONTROL SYSTEM FOR AN ELECTRIC OUTBOARD

BACKGROUND

1. Technical Field

This disclosure relates generally to watercraft motors. More particularly, apparatuses, systems, and methods for controlling and mounting an electric motor on a kayak are disclosed.

2. Background

Kayaking is a popular and growing sport and recreation. The typical method of kayaking involves manual paddling, but this can be laborious and exhausting for a paddler kayaking over long distances, or in unfavorable water currents or environmental conditions. A motor attached to the kayak can make for a more pleasant experience. There is a need for simple, modular and ergonomic apparatuses for attaching electric motors to watercraft, such as kayaks. Conventional systems for mounting electric motors on kayaks involve complex mechanisms, with awkward control systems that detract from the kayaking experience, and which require invasive disruption of the kayak structure. For instance, many control systems require a user to reach behind them to control the motor speed and direction. Further, many of these systems mount the motor to the kayak with complex and permanent structures requiring laborious methods. The present disclosure sets forth embodiments of an electric outboard mounting system for kayaks that is simple, employs control features which do not detract from the kayaking experience, and that can be more easily mounted to the kayak structure.

SUMMARY

The embodiments disclosed herein each have several aspects no single one of which is solely responsible for the disclosure's desirable attributes. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing kayak mounts and control systems.

In a first aspect, a motor steering apparatus for steering a watercraft motor is disclosed. The apparatus comprises a stabilizing member having a starting position and configured to couple to a watercraft peg linkage, wherein applying pressure to the watercraft peg linkage displaces the stabilizing member in a first direction. It further comprises a rotational member having a starting rotational position and coupled to the stabilizing member, the rotational member configured to couple with a motor drop-shaft, wherein displacement of the stabilizing member in the first direction rotates the rotational member in a first rotation direction, and wherein rotation of the rotational member in a first rotation direction rotates the motor drop-shaft in a first motor rotation direction, and an elastic member coupled to the rotational member. Upon decreasing the pressure applied to the watercraft peg linkage, the elastic member rotates the rotational member in a rotation direction opposite the first rotation direction and displaces the stabilizing member in a direction opposite the first direction. Upon completely removing the pressure applied to the watercraft peg linkage, the elastic member rotates the rotational member to the starting rotational position and displaces the stabilizing member to the starting position.

In a further aspect, the motor steering apparatus further comprises a second stabilizing member coupled to the rotational member, the second stabilizing member having a second starting position and configured to couple to a second watercraft peg linkage, wherein applying pressure to the second watercraft peg linkage displaces the second stabilizing member in the first direction, wherein displacement of the second stabilizing member in the first direction rotates the rotational member in a second rotation direction, and wherein rotation of the rotational member in a second rotation direction rotates the motor drop-shaft in a second motor rotation direction and a second elastic member coupled to the rotational member. Upon decreasing the pressure applied to the second watercraft peg linkage, the second elastic member rotates the rotational member in a rotation direction opposite the second rotation direction and displaces the second stabilizing member in a direction opposite the second direction. Upon completely removing the pressure applied to the second watercraft peg linkage, the second elastic member rotates the rotational member to the starting rotational position and displaces the second stabilizing member to the second starting position.

In an additional aspect, the motor steering apparatus further comprises a cable, the cable comprising a first end and a second end, wherein the first end couples the stabilizing member and second elastic member to the rotational member, and the second end couples the second stabilizing member and elastic member to the rotational member. Applying pressure to the watercraft peg linkage displaces the second stabilizing member in a second direction that is opposite the first direction and de-compresses the second elastic member. Displacing the second stabilizing member in a second direction compresses the elastic member. Applying pressure to the second watercraft peg linkage displaces the stabilizing member in a second direction that is opposite the first direction and de-compresses the elastic member, and displacing the stabilizing member in a second direction compresses the second elastic member.

In another aspect, the motor steering apparatus further comprises a frame, wherein the frame supports the stabilizing member, the second stabilizing member, the rotational member, the elastic member, and the second elastic member, and wherein the frame is configured to couple to a watercraft. In some embodiments, the frame is configured to couple to a watercraft at a single coupling location. In some embodiments, the frame is configured to couple to an off-the-shelf watercraft wherein the off-the-shelf watercraft is modified with a single hole. In some embodiments, the watercraft is a kayak.

In another aspect, the motor steering apparatus further comprises a wiring harness configured for quick connection and quick disconnection of a motor outside the kayak to an electrical unit inside the kayak. In some embodiments, the kayak further comprises a seat in a cockpit, and the electrical unit comprises a motor throttle control and is positioned adjacent to the seat. In some embodiments, the electrical unit is positioned in front of the seat.

In an additional aspect, the motor steering apparatus further comprises a first watercraft peg linkage, a second watercraft peg linkage, a first watercraft peg, and a second watercraft peg, wherein the first watercraft peg linkage links the first watercraft peg to the stabilizing member, and the second watercraft peg linkage links the second watercraft peg to the second stabilizing member. In some embodiments, the first and second watercraft pegs are foot pegs. In some embodiments, the foot pegs are configured to prevent slack in the linkages.

In a further aspect, the motor steering apparatus further comprises at least one stop pin, wherein the at least one stop pin limits the angle through which the rotational member may be rotated. In some embodiments, the rotational member is a pulley. In some embodiments, the pulley comprises at least one pin groove configured to communicate with the at least one pin stop to limit the angle through which the rotational member may be rotated, and a radial hole configured to receive a set screw to transfer rotational motion of the pulley to a drop-shaft. In some embodiments, the angle is 120 degrees.

In an additional aspect, the motor steering apparatus further comprises a motor drop-shaft coupled to the rotational member. In some embodiments, the motor steering apparatus further comprises a motor coupled to the motor drop-shaft. In some embodiments, the motor is an electric outboard.

In a further aspect, a mount apparatus for mounting a motor on a watercraft at a single location is disclosed. The apparatus comprises a mounting elbow comprising a rearward projection defining a rearward portion of a cavity and a downward projection defining a downward portion of the cavity, wherein the rearward and downward portions are at substantially a right angle to each other and are configured to receive a wire harness, the rearward projection configured to couple to an apparatus configured to couple to a motor, and the downward projection configured to extend through a hole in the watercraft. The apparatus further comprises an upper plate comprising an upper ring and two upwardly projecting ears, the upper ring defining an upper through hole between the two ears, the upper through hole configured to receive the downward projection of the mounting elbow, a top surface of the upper ring configured to abut the mounting elbow, and a bottom surface of the upper ring configured to abut an exterior surface of the watercraft. The apparatus further comprises a lower plate comprising a lower ring defining a lower through hole, the lower through hole configured to receive the downward projection of the mounting elbow, a top surface of the lower ring configured to abut an interior surface of the watercraft, and a bottom surface of the lower ring configured to abut a fastening device. The downward projection extends past the lower plate and is configured to receive the fastening device, thereby securing the lower plate, the upper plate, and the mounting elbow to the watercraft.

In a further aspect, a mount control system for controlling a motor on a kayak. The system comprises a motor steering apparatus comprising at least one watercraft peg linkage, a motor mount apparatus configured to be disposed rearward of an operator of the kayak, and an electrical unit comprising a motor throttle control. At least a portion of the watercraft peg linkage and the motor throttle control being configured to be located forward of the operator.

BRIEF DESCRIPTION OF THE DRAWINGS

The foregoing and other features, aspects and advantages of the present invention will now be described with reference to the drawings of certain embodiments, which are intended to illustrate and not to limit the present invention.

DETAILED DESCRIPTION OF CERTAIN EMBODIMENTS

Figure 1:
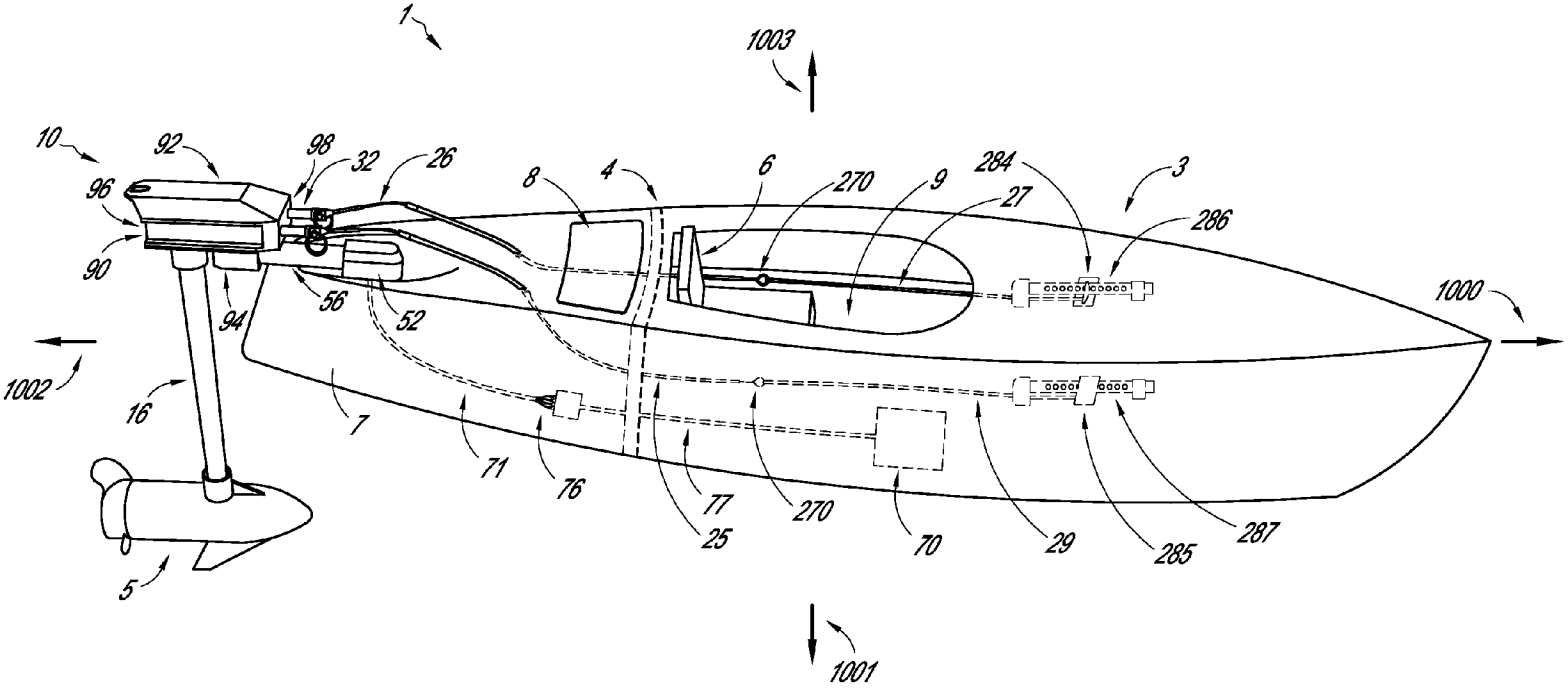
FIG. 1 is a perspective view of an embodiment of a mount and control system mounted to a kayak.

Embodiments of the invention will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the invention described herein.

The present disclosure concerns features for a system for controlling and mounting a motor to a watercraft, such as a kayak. The system provides for simple mounting and demounting of the motor. It also provides a control system to steer the motor. The control system allows a kayaker to maintain an optimal position and balance while kayaking. The mount and control systems further provide for a convenient positioning of the throttle and other motor controls.

Certain terms and phrases will be used for indicating directions and positions in describing the drawings and disclosure. As shown, for example in FIG. 1, direction 1000 may be referred to as the direction substantially toward the bow of the kayak 3. The direction substantially toward the opposite end of the kayak 3 may be referred to as toward the stern, and is indicated by direction 1002. The stern is also the side of the kayak 3 with the motor 5. Informally, the stern is the "rear" and the bow is the "front." Therefore, "towards the stern" of the kayak will refer to a position or location that is in or towards the rear of the kayak, as just defined. Conversely, "towards the bow" of the kayak refers to a position or location that is towards the opposite side of the stern, i.e. toward the front of the kayak, as just defined. Similarly, "aft" will refer to a direction that is towards the stern or rear, and "forward" will refer to a direction that is towards the bow or front. Thus the same direction, namely direction 1002 is indicated by rear, rearward, toward the rear, towards the stern, behind, or any variations thereof. Likewise, the same direction, namely direction 1000, is indicated by front, forward, toward the front, towards the bow, or any variations thereof. The directions of front and rear may also be referred to as the horizontal directions or orientation of the kayak 3. Shown in FIG. 2A, for example, direction 1001 may be referred to as the direction toward the bottom or lower side of the kayak 3, while direction 1003 may be referred to as the direction toward the top or upper side of the kayak 3. "Towards the bottom" or "below" or variations thereof therefore refer to a direction that is perpendicular to the front and rear directions 1000 and 1002. This is also the side of the kayak that would be in contact with the water when the kayak 3 is upright, as best shown in the side view of FIG. 2A. Direction 1003 may also be referred to by "towards the top" or "above" or variations thereof. The directions of above and below may also be referred to as the vertical directions or orientations of the kayak 3. Further, as shown in FIG. 2B, for example, direction 1004 may be referred to as the direction toward the left, left side, or variations thereof, of the kayak 3, while direction 1005 may be referred to as the direction toward the right, right side, or variations thereof, of the kayak 3. The directions of right, left, sides, etc. may also be referred to as the lateral directions or orientations of the kayak 3.

Finally, indicated directions include directions that are substantially in that direction. That is, they need not be exactly in the indicated direction. For instance, a feature on the bow is in front of any feature on the stern, even if the two features are not exactly laterally lined up. Thus, a feature on the bow may be further to the right or left of the feature on the stern, and the bow feature may still be said to be in front of the stern feature. Further, a feature may move toward the front and need not move in a direction that is exactly lined up with direction 1000.

Further, some features of the system 1 comprise symmetric or otherwise similar counterparts on an opposite side of the kayak 3, such as foot pegs 284 and 285, or rudder cords 25 and 26, or stabilizer pins 32, 33, etc. While reference may be made to features along one side of the system 1 or kayak 3, those descriptions, unless otherwise noted, apply equally to the counterparts of those features. Thus, for example, descriptions referring to foot peg 284 and rail 286, which are on the left side of some embodiments of the system 1, will generally apply equally to foot peg 285 and rail 287, which are on the right side of some embodiments of the system 1.

Figure 2A:
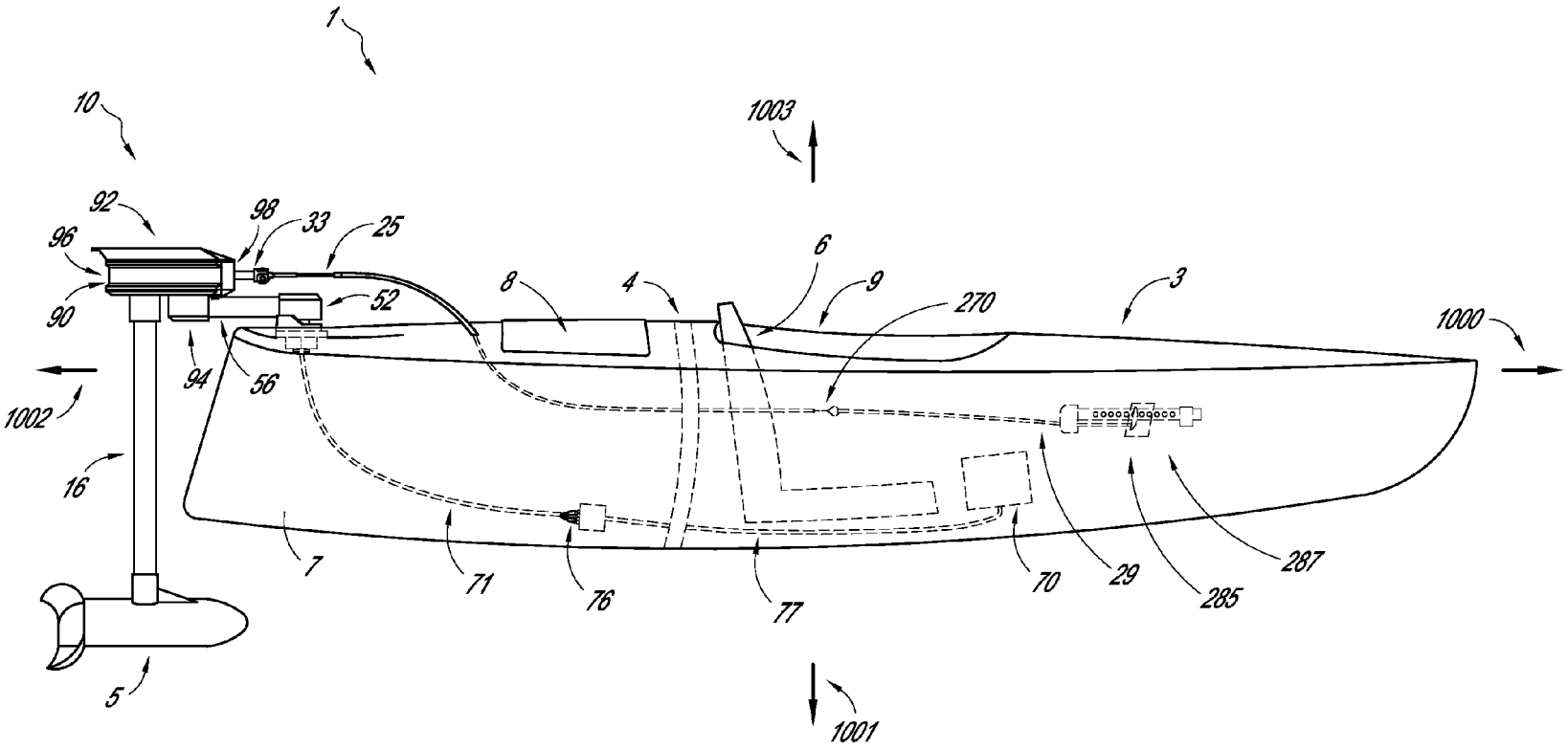
FIG. 2A is a side view of the system and kayak of FIG. 1.
Figure 2B:
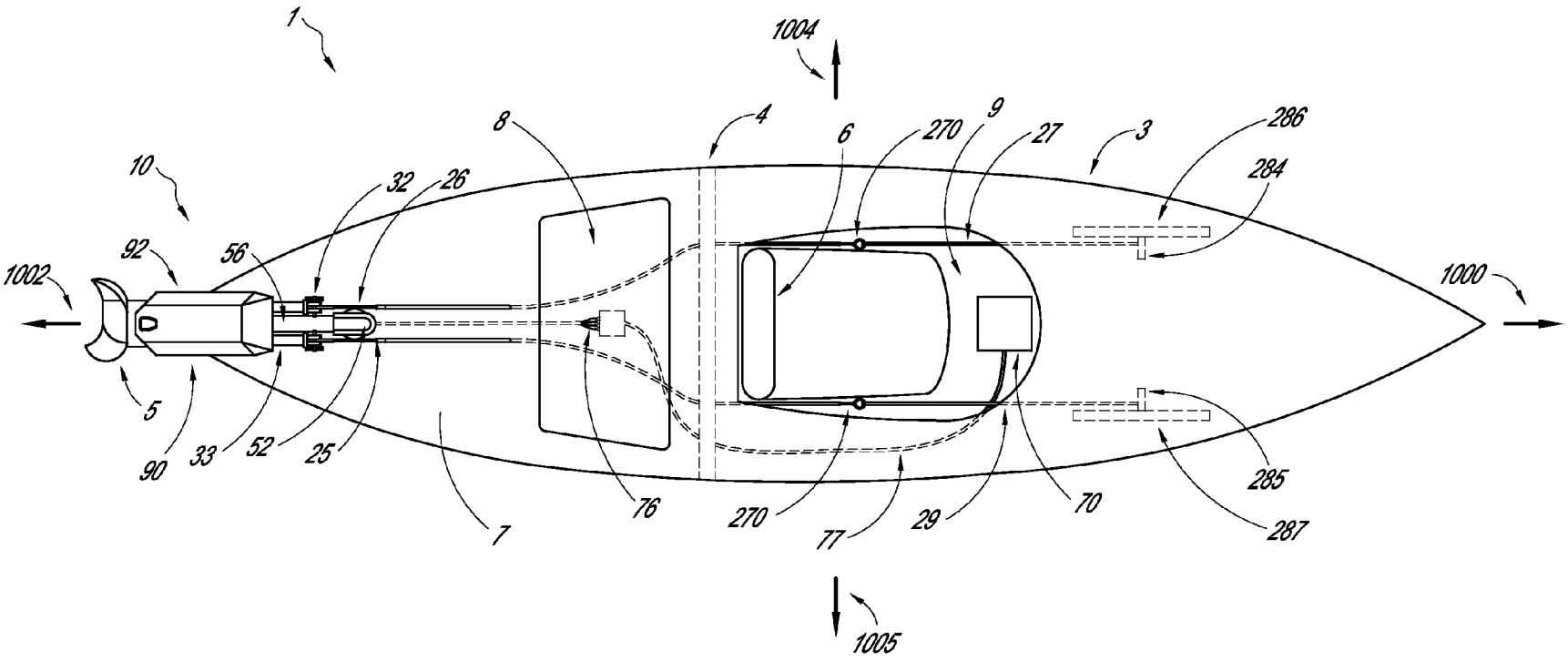
FIG. 2B is a top view of the system and kayak of FIG. 1.

Referring to FIGS. 1, 2A and 2B, an embodiment of a mount and control system 1 with motor 5 is shown mounted to and installed on a kayak 3. The kayak 3 is a craft meant to carry and keep a person and/or things afloat in a body of water. The embodiment of the kayak 3 shown is a recreational sit-in kayak, however it may be other types of kayaks or watercraft intended for a variety of purposes, including, without limit, tandem, two-seater, white water, sea, touring, surf, sit-on-top, urban or fishing kayaks and watercraft. The kayak 3 may be made of plastic, fiberglass, Kevlar, inflatable material, or any other number of materials. The body of the kayak 3 embodied in FIGS. 1, 2A and 2B is between 9 and 15 feet long in the horizontal direction and has a V-shaped hull or body, but the system 1 may be adapted to a number of differently shaped kayaks with a variety of sizes. In some embodiments, the kayak 3 may be longer or shorter, wider or thinner, and may have a differently shaped hull. The stern of the kayak 3 also has a V shape as shown, but in some embodiments the stern may be flatter or completely flat as well. Still other embodiments of a kayak 3 may have other sizes, shapes, configurations, materials and characteristics that are within the scope of the present disclosure.

In some embodiments, the kayak 3 has a cockpit 9 containing a number of components of system 1. As shown, a seat 6 is inside the cockpit 9. Towards the bow of the kayak 3, the cockpit 9 further contains a foot peg system comprising foot pegs 284, 285 and rails 286 and 287. In some embodiments, on the sides of the cockpit 9, the rail 286, 287 supports the foot peg 284, 285. The rails 286 and 287 are positioned inside the cockpit 9 such that a kayaker may easily reach the foot pegs 285 and 286 with their feet when sitting in the seat 6. The rails 286 and 287 in some embodiments are positioned in the same location as in a standard off-the-shelf kayak 3 or watercraft. In other embodiments, the rails 286 and 287 are custom located to accommodate the size of a kayaker and/or to adjust certain settings of system 1. Some off-the-shelf kayaks 3 may come with foot pegs 285 and 286 that have a locking mechanism. In some embodiments of the repent disclosure, this foot peg locking mechanism on the kayak 3 may be disengaged, and the foot pegs 284, 285 may be spring-loaded to take up slack in the system 1. The spring-loading may be between the pegs 284, 285 and rails 286 and 287, respectively. In some embodiments, the pegs 284, 285 may be spring-loaded to a connecting cord, as discussed in further detail herein. The foot pegs 284, 285 and 285 may be further adjusted along the rails 286 and 287 for finer accommodations and settings. In some embodiments, the foot pegs 284, 285 are adjusted such that they are on the forward end of the rails 286 and 287. In other embodiments, the foot pegs 284, 285 are located on the rearward end of the rails 286. Further, the rails 286 and 287 and foot pegs 284 and 285 need not be in the same location as each other. For example, a rail 286 on the left side of the cockpit 9 may be further forward or aft than the rail 287 on the right side of the cockpit 9, and similarly a foot peg 284 on the left side of the cockpit 9 may be further forward or aft than the right side foot peg 285. Other modifications to the rails 286 and 287 and foot pegs 284, 285 are within the scope of the disclosed system 1.

Each foot peg 284, 285 is connected to a cord 27, 29, respectively. In certain embodiments, the cord 27, 29 is a Samson cord. The cords 27, 29 provide an adjustable-length linkage of variable elasticity from the foot pegs 284, 285 to a rudder cord 26, 25. In some embodiments, an end of the cord 27, 29 attaches to the foot peg 284, 285 toward the bottom of the foot peg 284, 285. When the foot peg 284, 285 is moved forward, the cord 27, 29 also moves forward, thereby transmitting the movement. The foot pegs 284, 285, as is discussed in further detail herein, provide a means to control and steer the motor 5. From the foot peg 284, 285, the cord 27, 29 extends through the cockpit 9 in a rearward direction. In some embodiments, the cords 27, 29 extend along the sides of the seat 6. Further, the cords 27, 29 may be free or may have guides to assist with their movement. In some embodiments, the cord 27, 29 terminates with a cord coupling 270. In some embodiments, the cord coupling 270 is a looped, metallic piece around which the rudder cord may attach, as is discussed in further detail herein.

The cord 27, 29 in some embodiments is an inelastic, multi-strand, synthetic fiber cord, providing a lightweight, high-performance cord. The cord 27, 29 may be standard, off-the-shelf Samson ropes made with Dyneema fiber, but it may also be modified and/or custom rope. Further, the cord 27, 29 may also be any number of materials and configurations with a range of mechanical properties. For instance, the cord 27, 29 may be metallic, non-metallic, plastic, composite, carbon fiber, or fibrous wire and/or single strand with elastic and/or inelastic properties. Elastic and inelastic here refer to the ability of the cord 27, 29 to stretch when under tension, sometimes referred to as strain. In other embodiments, the cord 27, 29 may be substantially elastic, substantially inelastic, a combination of both, or it may be inelastic and become elastic after a threshold amount of tensile force is applied.

Variability in the elasticity of the cord 27, 29 allows for variations in the settings of the control system, such as responsiveness or damping, as is further discussed in detail herein. For instance, an inelastic cord 27, 29 may allow for a tighter and more responsive control system, and a more elastic cord 27, 29 may be used to provide a looser, less responsive control system. Responsive here refers to the output or reaction of the control system for a given input. A more responsive control system, for instance, may rotate the motor 5 through a larger angle for a given linear movement of the foot pegs 284, 285. Conversely, in a less responsive system, the same linear movement of the foot pegs 284, 285 may rotate the motor 5 through a smaller angle. In some embodiments the elasticity of the two cords 27, 29 are similar. In other embodiments, the elasticity of the two cords 27, 29 may be different to accommodate a kayaker's needs, for example, if one leg is weaker or otherwise more sensitive than the other leg. Many variations in elasticity of the cord 27, 29 may be implemented to achieve a wide range of settings and responsiveness of the system.

In some embodiments, the cord 27, 29 may be adjusted in length. The length may be adjusted with, for example, a turnbuckle, an adjustor, or with replaceable cord 27, 29 segments of shorter or longer lengths. The length may further be adjusted in a number of other implementations that will be readily apparent to one skilled in the art.

Variability in the length of the cord 27, 29 also allows for variations in the settings of the control system, as is further discussed in detail herein, and accommodates kayakers of various sizes and positions. For instance, shortening of the cord 27, 29 allows the foot pegs 284, 285 to be moved rearward along the rails 286, 287. This position may allow for a tighter and more responsive control system, and/or it may accommodate a shorter kayaker or allow for bending of one's legs while kayaking. Likewise, elongating the cord 27, 29 allows the foot pegs 284, 285 to be moved forward along the rails 286, 287. This position may allow for a looser and less responsive control system, and/or it may accommodate a taller kayaker or allow for straightening of one's legs while kayaking. The cord 27, 29 may also be adjusted in position to change or maintain a level of responsiveness. In some embodiments, the cord 27, 29 may be tied off in relation to the foot pegs 284, 285, thus allowing both taller and shorted kayakers to adjust the foot pegs 284, 285 for their respective heights while maintaining or altering a level of responsiveness in the system 1. For example, the foot pegs 284, 285 and cord 27, 29 may be adjusted so that one inch of travel of the foot pegs 284, 285 results in the motor rotating 120 degrees. Many variations in length, along with variations in elasticity, of the cord 27, 29 may be implemented to achieve a wide range of settings and accommodations of the system, as will be readily apparent to one skilled in the art.

As mentioned, the cord 27, 29 in some embodiments terminates with a coupling 270 that connects the cord 27, 29 to a rudder cord 26, 25. In some embodiments, this connection is inside the cockpit 9 next to the seat 6. In other embodiments, this connection is further forward or aft of this position, either within the cockpit 9 or in other compartments of the kayak 3. As discussed in further detail herein, the rudder cord 26, 25 may connect to the cord coupling 270 with a rudder cord coupling 262.

Referring to FIGS. 1-2B and 15, the rudder cord 26, 25 may extend from the coupling 270 of the cord 27, 29 in the aft direction along the side of the seat 6. The cord 26, 25 may also run under, through, or otherwise around the seat 6. In some embodiments, the rudder cord 26, 25 penetrates through a bulkhead 4 in the kayak 3. The bulkhead 4 is behind the seat 6. The bulkhead 4 is a structural reinforcement of the kayak 3 that also separates the cockpit 9, in which the seat 6 is located, from a dry storage 7, which is the internal part of the kayak 3 that is behind the bulkhead 4. In some embodiments, the bulkhead 4 has a hole through which passes the rudder cord 26, 25. As shown, each rudder cord 26, 25 passes through its own hole in the bulkhead 4, but other variations may be implemented, such as sharing of a single hole or multiple holes. The holes are shown located near the top of the bulkhead 4 and spaced to allow the cord 27, 29 and a forward portion of rudder cord 26, 25 to be straight. Other locations and spacing may be implemented, providing for other configurations and orientations of the cord 27, 29 and a forward portion of the rudder cord 26, 25, and are within the scope of the present disclosure.

The rudder cords 26, 25 continue behind the bulkhead 4 into the dry storage 7 and underneath a hatch 8. The dry storage 7 provides a storage compartment where items may be stored and kept dry, for example, from water. It also houses and keeps dry certain components of the mount and control system 1, such as an end of a wire harness 71 and a quick electrical disconnect 76, as is further discussed herein, that may be easily accessed via the hatch 8. The hatch 8 is a moveable or removable door or panel that provides access to the dry storage 7. In some embodiments, the hatch 8 is hinged to the kayak 3 structure and may be rotated to reveal or conceal the interior of the dry storage 7, thereby providing access to or closing off the interior and its components.

As best shown in FIG. 2B, in some embodiments the rudder cords 26, 25 may not continue in a straight path behind the bulkhead 4. The rudder cords 26, 25 may take a more narrowed path in the dry storage 7 in order to protrude through the top of the kayak 3 near the rear of the storage 7. However, in other embodiments, the rudder cords 26, 25 may not take such a narrowed path, or they may narrow to a greater or lesser degree. The configurations shown are merely some embodiments and others may be readily implemented with the system 1.

Referring to FIGS. 1-2B, the rudder cords 26, 25 protrude through the top of the dry storage 7 behind the hatch 8. In some embodiments, a protective sheath surrounds and protects the rudder cords 26, 25 on the exterior of the dry storage 7. This sheath protects the rudder cords 26, 25 from the elements and prevents chafing. The rudder cords 26, 25 in some embodiments each protrude through their own hole in the dry storage 7. The holes are spaced to align with the stabilizer pins 32, 33. In other embodiments, the rudder cords 26, 25 may protrude through a single hole, or the holes may be spaced and/or located in other configurations. The rudder cords 26, 25 then extend rearward and terminate at one end with a pin coupling 260, as is discussed in further detail with respect to, for example, FIGS. 4 and 15. This end of the rudder cord 26, 25 couples to the stabilizer pin 32, 33. Movement of the rudder cords 26, 25 is transmitted to the stabilizer pins 32, 33, as is discussed in further detail herein, which in part allows for rotation and steering of the motor 5.

As shown, for example in FIG. 1-2B, the stabilizer pins 32, 33 enter a frame assembly 90. The frame assembly 90, among other things, houses the control subsystem 10, as is discussed in further detail herein. In some embodiments, the frame assembly 90 is comprised of an upper frame 92, a lower frame 94, a frame 96, and a frame extension 98. In some implementations, the stabilizer pins 32, 33 enter the frame assembly 90 through the frame extension 98 and frame 96. Above the frame extension 98 and frame 96 is the upper frame 92, and below them is the lower frame 94. The rearward portion of lower frame 94 couples to one end of a vertical drop-shaft 16. The other end of the drop-shaft 16 couples to the motor 5.

As is discussed in further detail herein, the mount and control system 1 transmits and converts substantially linear motion of the foot pegs 284, 285 into rotational motion about a rotational axis of the drop-shaft 16. Rotation of the drop-shaft 16 rotates the motor 5 and thereby provides steering of the kayak 3. The frame assembly 90 and drop-shaft 16 further house portions of the wiring harness 71, as discussed in further detail herein.

In some embodiments, the motor 5 may be rotated, and the kayak therefore steered, as follows: a left side foot peg 284 is pressed forward. This in turn pulls forward the cord 27 attached to the foot peg 284. That same cord 27 then pulls forward the rudder cord 26 to which it is coupled. That same rudder cord 26 then pulls forward the stabilizer pin 32 to which it is coupled. As is discussed in further detail herein, pulling of the stabilizer pin 32 on, for example, the left side of the kayak 3, will in some embodiments rotate the motor 5 such that the kayak 3 will steer to the left. Similarly, pressing forward on a right side foot peg 285 will result in pulling of the stabilizer pin 33 on, for example, the right side of the kayak 3, which in some embodiments will rotate the motor 5 such that the kayak 3 will steer to the right. Other configurations may be implemented that are within the scope of the present disclosure.

In some embodiments, pressing the foot peg 284, 285 forward may be done by applying pressure to the foot peg 284, 285 in the forward direction with, for instance, a foot. In some embodiments, as is discussed in further detail herein, decreasing this pressure will allow the system 1 to move the foot peg 284, 285 in a rearward direction. Therefore, in some embodiments, pressure may be applied to move the foot peg 284, 285 forward to steer the kayak 3 in a first direction, and then removal of that pressure will result in the foot peg 284, 285 moving rearward and thereby steering the kayak 3 toward a direction opposite the first direction.

In some embodiments, applying no pressure to either a left or right foot peg 284, 285 will result in the mount and control system 1 rotating the motor 5 toward, and/or maintaining the motor 5 in, a central position such that the kayak 3 does not steer right or left but rather travels straight or substantially in the direction 1000. Straight here may refer to substantially in the forward direction. However, the system 1 in some embodiments may steer the kayak 3 slightly to either the left or right when the motor 5 is in the central position, in which case straight may also refer to the slight left or right. For example, a water current or wind in a direction that is angled with respect to the kayak's 3 direction of travel may cause the motor 5 to not track exactly straight.

As best shown in FIG. 2A, the forward portion of lower frame 94 couples to one end of a wire tunnel 56. As is discussed in further detail herein, the wire tunnel 56 provides a substantially horizontal extension such that the frame assembly 90 and therefore the motor 5 extends beyond the stern of the kayak 3, providing the motor 5 access to the water. The wire tunnel 56 may be implemented in various lengths to accommodate various configurations of the kayak 3. For instance, for the kayaks 3 with V-shaped, pointed, rounded or otherwise extended sterns, in some embodiments, a longer wire tunnel 56 may be used to extend the rearward portion of the system 1 beyond the rearward tip of the kayak 3. In other embodiments, a shorter wire tunnel 56 may be implemented, for instance, where the stern is a shallower or shorter V-shape or is flat. Further, while the wire tunnel 56 is shown as horizontal, it may also be skewed or canted to accommodate various configurations and styles of the kayak 3, or to provide for different orientations of the motor 5. In some embodiments, the wire tunnel 56 is cylindrical and hollow and houses a portion of the wire harness 71, as is discussed in further detail herein. Other configurations and shapes of the wire tunnel 56 may be implemented.

The forward portion of the wire tunnel 56 couples to a mounting elbow 52. In some embodiments, the mounting elbow 52, among other things, mounts the rearward portion of the mount and control system 1 to the kayak 3, as is discussed in further detail herein, and further houses a portion of the wire harness 71. The mounting elbow 52 receives the wire tunnel 56 in a substantially horizontal orientation and mounts to the kayak 3 in an substantially vertical orientation. Therefore, the mounting elbow 52 in some embodiments has a substantially ninety degree, or right angle, configuration. The vertical or bottom portion of the mounting elbow 52 couples to the kayak 3 and provides access for the wire harness 71 to the dry storage 7.

The wire harness 71 is a collection of wires carrying electrical current and provides, among other things, power and control to the motor 5. In some embodiments, the wire harness 71 connects to the motor 5 and terminates at a quick electrical disconnect 76. The disconnect 76 couples to an electrical extension 77 at a location in some embodiments that is in the dry storage 7 and approximately underneath the hatch 8. This location allows for easy access to the disconnect 76 and provides for simple and quick attachment and detachment of the wire harness 71 when installing or removing parts of the mount and control system 1, as is further discussed in detail herein.

In some embodiments, removal of most of the mount and control system 1 may be done by disconnecting the system 1 at only a few interfaces. In some embodiments, only three interfaces are required to be disconnected. As mentioned, one interface is where the quick electrical disconnect 76 couples with the electrical extension 77, which frees the system at the end of the wire harness 71 containing the disconnect 76. Another interface is coupling of the rudder cords 26, 25 to the stabilizer pins 32, 33, as mentioned. A third interface is the mounting elbow 52 and the kayak 3. Disconnecting the respective parts at these three interfaces allows for removal of the rearward portion of the mount and control system 1, including the motor 5, but leaving, for example, the rudder cords 26, 25, cords 27, 29, foot pegs 284, 285, rails 286, 287, electrical extension 77 and electrical subsystem 70 with the kayak 3. The motor 5 and much of the system 1, therefore, can easily and quickly be removed from the kayak 3. This is useful for transporting and storing the kayak 3, and it further may help prevent theft of the motor. Further details of the disconnect features are further discussed herein. In other embodiments, other configurations, positions, and locations of disconnect interfaces may be implemented. The embodiments described here are merely for illustration and do not exhaust the possible embodiments that may be used for simple and quick removal of the system 1. Further, the interfaces of any embodiment also provide for easy and quick connection or installation of the system 1 to the kayak 3. It is therefore understood that any description of the disconnection structures and functions applies equally to connecting or installing the system 1. In other embodiments, other components or features of the system 1 may be removed from and attached to the kayak as well, and such implementations are within the scope of the present disclosure.

As mentioned, an electrical extension 77 is coupled to the electrical disconnect 76 at an interface which, in some embodiments, is inside the dry storage 7. From this interface, the extension 77 then continues forward through the bulkhead 4 and into the cockpit 9 on the forward side of the bulkhead 4. As shown in FIGS. 1-2B, the extension 77 extends or runs through a single hole in the bulkhead 4 and along the side of the seat 6. In other embodiments, the extension 77 runs underneath the seat 6. In some embodiments, the extension 77 may be split and run through multiple holes in the bulkhead 4, and it may, either in part or in whole, run along the same side of and/or underneath the seat 6. Other configurations and orientations of the extension 77 and its penetration through the bulkhead 4 may be implemented and are within the scope of the present disclosure. For instance, the electrical extension 77 may run through the same hole in the bulkhead 4 that the rudder cord 26, 25 runs through. Therefore, the embodiments disclosed are merely for illustration, and it is understood that a multitude of other configurations and orientations are possible.

The electrical extension 77 terminates at an electrical subsystem 70. The subsystem 70 houses the electrical accessories related to power and throttle control of the motor 5. In some embodiments, the electrical subsystem 70 is a box or box-like structure that is secured to the kayak 3 so that it stays intact in case of overturn while kayaking or transporting the kayak 3. In some embodiments, as shown in FIGS. 1-2B, the electrical subsystem 70 is advantageously located in a forward portion of the cockpit 9 in front of the seat 6 and secured to the floor of the kayak 3. In other embodiments, the subsystem 70 has a platform to which it is secured and installed, and the platform is secured to the kayak 3 floor. Other configurations may be implemented and integrated with the system 1 that are within the scope of the present disclosure.

The location of the electrical subsystem 70 as shown in FIGS. 1-2B allows for easy access to the subsystem 70. Having the subsystem 70 in front of the seat allows a kayaker in the seat 6 to adjust the power, throttle and other electrical switches while seated and without having to turn around. Conventional motors require a user to reach behind them or to the side to adjust the power and throttle of the motor 5 on the back of the kayak 3. The present disclosure provides the benefit of being able to adjust the power, throttle, and more without requiring an inconvenient and awkward positioning of the kayaker. This provides for a unity or "oneness" between the kayaker and the kayak 3 and thereby produces a more fruitful and enjoyable kayaking experience. In some embodiments, the subsystem 70 may be positioned along either side of, underneath, adjacent to, or attached with, the seat 6.

Further contributing to the "oneness" of the present disclosure are the foot pegs 284, 285. As is discussed in further detail herein, the foot pegs 284, 285 are spring-loaded to provide a constant tension in the cords. The spring-loaded foot pegs 284, 285 along with the stabilizing features of the control subsystem 10 provide the unity between a kayaker and kayak 3 that allows for a secure and tight feeling while navigating the waters.

Figure 3:
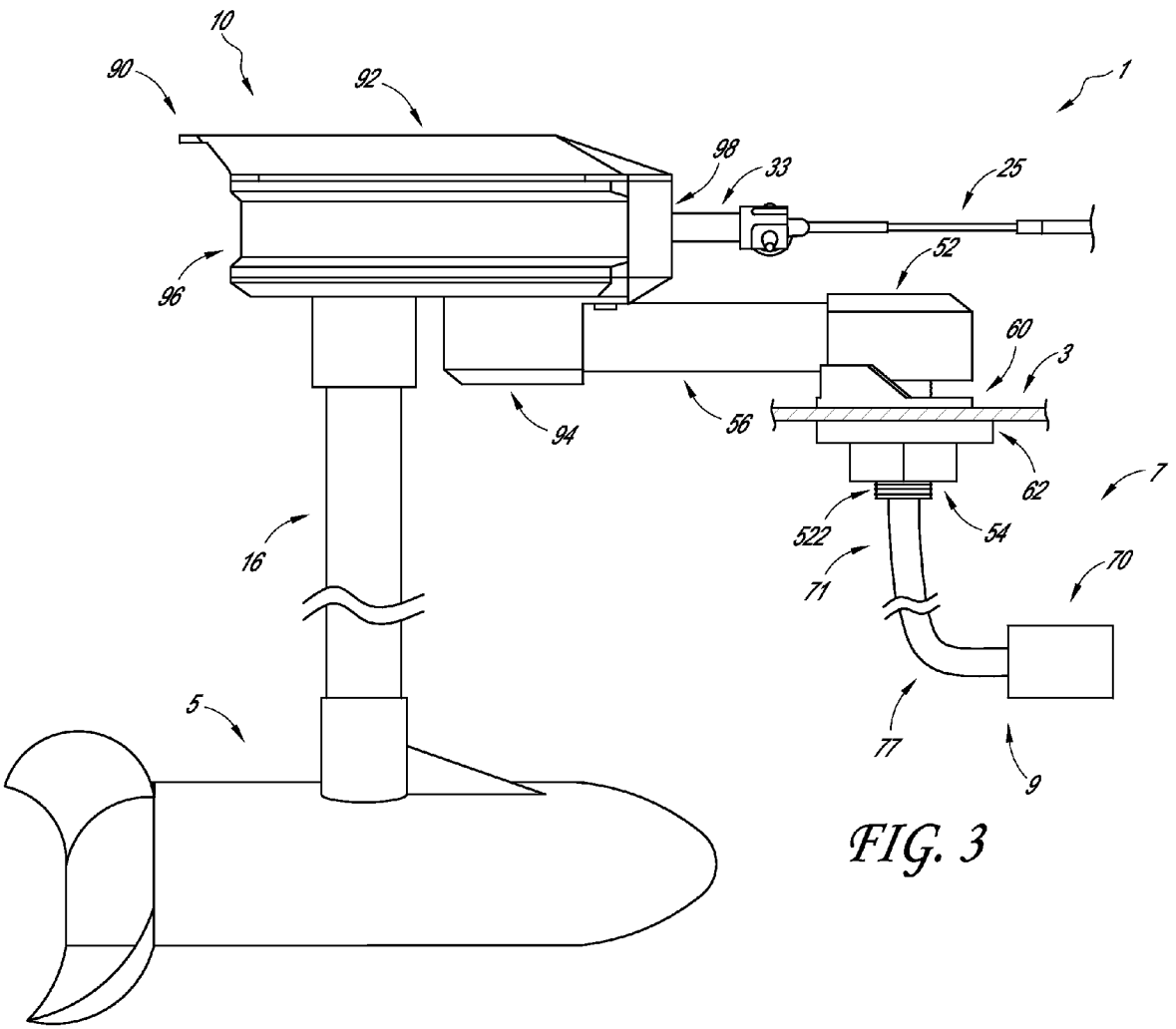
FIG. 3 is a side view of an embodiment of a rearward portion of a mount and control system.

FIG. 3 is a side view of an embodiment of a rearward portion of the mount and control system 1 for the motor 5. Shown in FIG. 3, among other things, are some of the connection points or interfaces between the system 1 and the kayak 3. One of these interfaces, as mentioned, involves a mounting elbow 52 coupling the wire tunnel 56 to an interface at the kayak 3. At this interface, the system 1 comprises features on either side of the kayak 3. That is, some features are on the exterior of the kayak 3 and some are on the interior, for example, in the dry storage 7.

Features at this interface on the exterior of the kayak 3 include, among others, an upper plate 60 and a portion of the mounting elbow 52. A top surface of the upper plate 60 abuts the mounting elbow 52, while the bottom surface of the upper plate 60 abuts the exterior surface of the kayak 3. In FIG. 3, a partial section view of the kayak 3 is shown for clarity.

In some embodiments, the upper plate 60 directly contacts the kayak 3. In other embodiments, a spacer 601, see FIG. 22B, is sandwiched between the upper plate 60 and the kayak 3. The spacer 601 may provide separation between the kayak 3 and the upper plate 60. This separation allows for vertical adjustment of the rearward portion of the mount and control system 1. For instance, placing a half-inch spacer 601 between the kayak 3 and upper plate 60 will raise the rearward portion of the mount and control system 1, including the motor 5, approximately a half-inch. In other embodiments, more than one spacer 601 may be implemented. For instance two spacers 601 each a half-inch thick could be installed between the upper plate 60 and the kayak 3, which would vertically raise the motor 5, and associated parts, approximately one inch.

The separation between the kayak 3 and an upper plate 60 provided by a spacer 601 also prevents negative interaction between the upper plate 60 and the kayak 3. For instance, discrepancies in the chemical or material properties between the materials of the upper plate 60 and the kayak 3 may lead to adverse chemical reactions or structural damage. A more suitable spacer 601 material may alleviate these concerns, for instance chemically or electrically isolating the materials, or providing a softer material that prevents or mitigates deformation of a softer kayak 3 structure such as some plastics or polymers.

Features at this interface on the interior of the kayak 3 include a lower plate 62, a fastening device such as a nut 54, and a portion of the mounting elbow 52. The top surface of the lower plate 62 abuts the interior surface of the kayak 3. In some embodiments, the lower plate 62 directly contacts the kayak 3. In other embodiments, a spacer 601, such as that shown in FIG. 22B, is sandwiched between the lower plate 62 and the kayak 3. The spacer 601 may provide separation between the kayak 3 and lower plate 62, for the same or similar reasons as the separation between the kayak 3 and the upper plate 60, as mentioned above.

The portion of the mounting elbow 52 on the interior of the kayak 3 includes a projection comprising a threaded portion 522. This threaded portion 522 extends through the upper plate 60, kayak 3, and lower plate 62. External threads of threaded portion 522 mate with internal threads of the nut 54. In this manner, the nut 54 secures the mounting elbow 52, upper plate 60, and lower plate 62, along with any spacers 601, to the kayak 3. In some embodiments, the kayak 3 is provided with a hole large enough to receive the threaded portion 522 of mounting elbow 52. The nut 54 that is tightened to secure the interface may be accessed in some embodiments through the hatch 8 of the kayak 3. In other embodiments, the kayak 3 may comprise other access ports to tighten and loosen the nut 54.

The wire harness 71 is on the top and bottom side of this interface, as the wire harness 71 runs through the threaded portion 522 of mounting elbow 52. It can be seen in FIGS. 3 and 4 exiting/entering the threaded portion of elbow 52 into the dry storage 7 of the kayak 3. As further shown in FIGS. 3 and 4, the wire harness 71 connects to the electrical extension 77. For clarity, only a portion of the lengths of the harness 71 and extension 77 are shown. As mentioned, the extension 77 connects to the electrical subsystem 70 in the cockpit 9.

Figure 4:
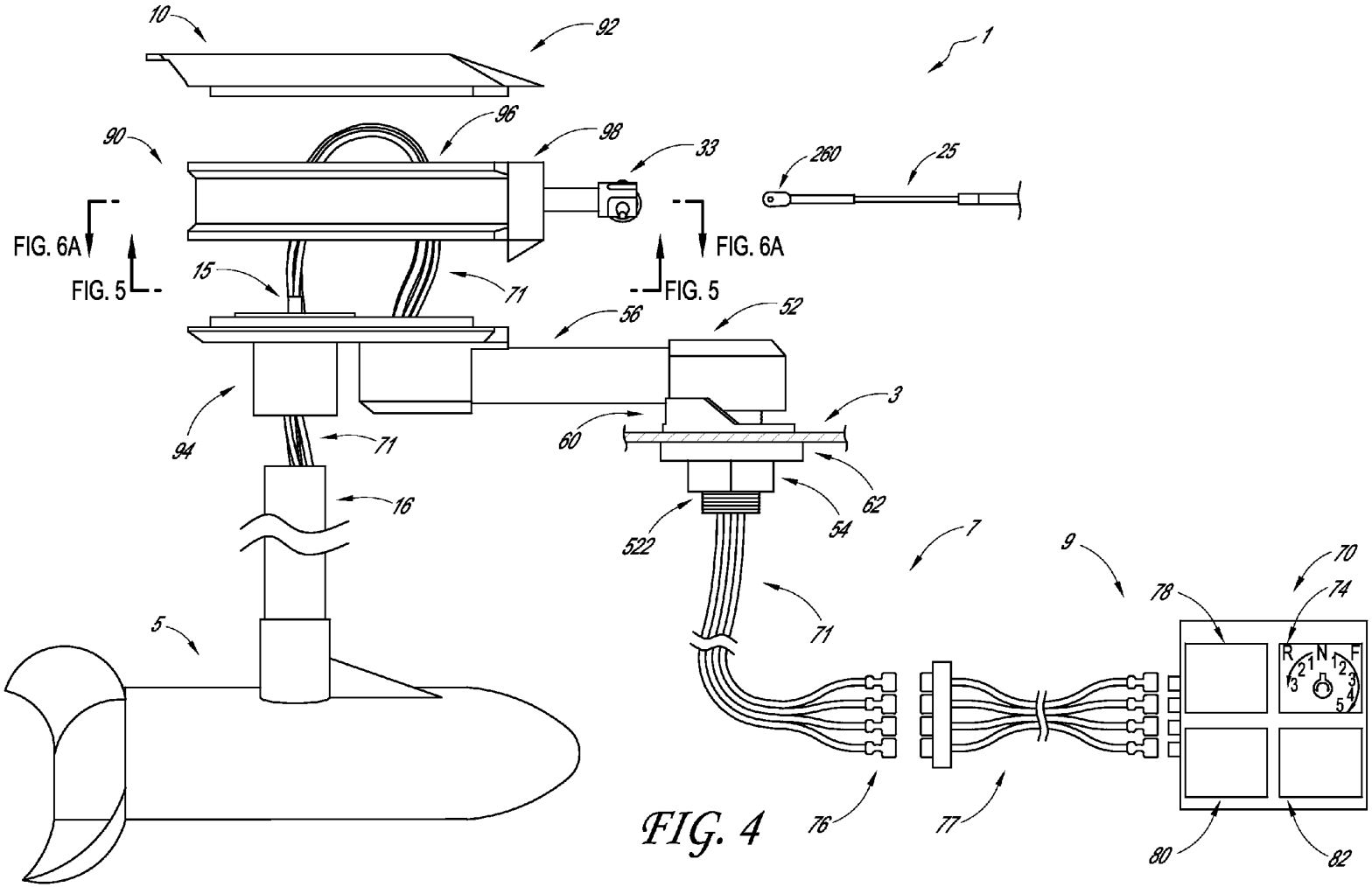
FIG. 4 is a partially exploded view of the system of FIG. 3.

FIG. 4 is a partially exploded view of a rearward portion of an embodiment of a mount and control system 1 with the motor 5.

As shown in FIG. 4, in some embodiments, the wire harness 71 connects the quick electrical disconnect 76 to the motor 5. From the quick electrical disconnect 76 in the cockpit 9, the wire harness 71 extends through the bulkhead 4, see FIGS. 1-2B, and into the dry storage 7. Inside the dry storage 7, the wire harness 71 then extends in a substantially vertical direction through the threaded portion 522 of mounting elbow 52. The mounting elbow 52 guides the wire harness 71 towards the wire tunnel 56. Next, the wire harness 71 extends into the lower frame 94. The lower frame 94 guides the wire harness 71 into the frame 96. The wire harness 71 then loops around into a recess in the upper frame 92 and extends back down through the frame 96 and the lower frame 94. From the lower frame 94, the wire harness 71 extends substantially downward into and through the drop-shaft 16. Next, the wire harness 71 connects to the motor 5.

Some embodiments of the wire harness 71 are shown in the configurations and orientations, for example, in FIG. 4. The wire harness 71 may be implemented in a variety of other configurations and orientations. Further, the wire harness 71 may in some embodiments run through more or fewer of the parts mentioned. For instance, the wire harness 71 in some embodiments does not extend into the recess of upper frame 92. Further, it is understood that FIG. 4 is an exploded view whereby the parts are shown detached from each other for clarity of certain features.

In some embodiments, the lower surface of the upper frame 92 couples to top surfaces of the frame 96 and frame extension 98. The lower surfaces of the frame 96 and frame extension 98, in turn, couple to top surfaces of the lower frame 94. Details of the coupling embodiments are discussed further herein.

As further shown in FIG. 4, the lower frame 94 comprises pin stops 15. In some embodiments, there are two pin stops 15, however the pin stops are substantially aligned laterally, and therefore only one pin stop 15 is visible in the side view of FIG. 4. As is discussed in further detail herein, the pin stops 15 assist with preventing over-rotation of the motor 5.

Another interface is shown in the embodiment in FIG. 4 of a pin coupling 260 on an end of a rudder cord 25. It is understood that, for clarity, only a portion of the rudder cord 25 is shown. The pin coupling 260 is shown detached from the stabilizer pin 33. As is discussed in further detail herein, the pin 33 provides for quick and easy connection and disconnection of the pin coupling 260 to the stabilizer pin 33. In some embodiments, the stabilizer pin 33 has a hole that receives a standard quick release pin. The pin coupling 260 captures this quick release pin. To install the system 1, the pin coupling 260 is attached to the stabilizer pin 33 using the quick release pin. To remove the system 1, the pin coupling 260 is detached from the stabilizer pin 33 using the quick release pin. Similar features and functions apply to the pin coupling 260, the rudder cord 26 and stabilizer pin 32. The rudder cord 26 and stabilizer pin 32 are not visible in FIG. 4 but are shown, for example, in FIGS. 1 and 2B.

An embodiment of an interface shown in FIG. 4 comprises the quick electrical disconnect 76 on an end of the wire harness 71. The disconnect 76 couples to the electrical extension 77 inside the dry storage 7, as mentioned. This interface between the disconnect 76 and the extension 77 provides one of the interfaces by which the rearward portion of the mount and control system 1 may be easily and quickly attached to, and detached from, the remainder of the system 1 and kayak 3. The configurations and orientations of the parts associated with this interface are shown as an illustration of an embodiment. The interface may be embodied and implemented in a variety of configurations and orientations that are within the scope of this disclosure. For instance, the interface between the quick electrical disconnect 76 and electrical extension 77 in some embodiments may be in a different location inside the dry storage 7, such as farther from the bulkhead 4, or on another side of the kayak 3, as further discussed herein. In other embodiments, this interface is in the cockpit 9, where the wire harness 71 extends through the bulkhead. In additional embodiments, the wire harness 71 and electrical extension 77 are a unitary wire harness and the interface is with the electrical subsystem 70. A range of other embodiments may be implemented and the illustration of some interface embodiments is not meant to limit the present disclosure to only those addressed.

The wire harness 71 in some embodiments comprises a wire or bundle of wires that carries electrical current from various components of the electrical subsystem 70 to the motor 5. The wire comprises a substantially electrically conducting core surrounded by a substantially electrically insulating and protective outer layer. In some embodiments, the wire harness 71 comprises four wires, although more or fewer wires may be implemented. The wire harness 71 may therefore comprise a quick electrical disconnect 76 on the end that comprises four disconnects, as shown, or it may comprise more or fewer disconnects. The quick electrical disconnect 76 allows for easy and quick coupling and de-coupling of the wire harness 71 to the electrical extension 77. The wire harness 71 may comprise a positive and a negative wire to transmit variable electrical current from a battery 78 to the motor 5. In some embodiments, the motor 5 is further grounded by a wire in the wire harness 71 to a ground in the electrical subsystem 70. Additional embodiments may comprise a neutral wire in the wire harness 71 from the motor 5 to the electrical subsystem 70. It is understood that the length of the wire harness 71 as depicted in FIGS. 3 and 4 is truncated for clarity, and the length of the wire harness 71 may be short or long, for example from about a couple feet (or less) to several (or more) feet long.

FIG. 4 further illustrates an embodiment of an electrical subsystem 70. In some embodiments, the electrical subsystem 70 comprises a speed selector 74, a battery 78, a circuit breaker 80, and a kill switch 82.

In some embodiments, the speed selector 74 comprises reverse, neutral, and forward settings. In some embodiments, the reverse setting may have three speeds at which the motor 5 may be run in reverse. The reverse setting may be used for moving the kayak 3 in a rearward direction and/or for braking. In some embodiments, the forward setting may be used for moving in the forward direction and comprise five settings at which the motor 5 may be run. A neutral setting may also be implemented to idle the motor 5. Other embodiments of the speed selector 74 may be implemented, for instance with more or fewer reverse and/or forward settings.

In some embodiments, the battery 78 comprises an electric battery and provides a source of electric power or energy to run the motor 5. The battery 78 may be a single battery 78 or may comprise multiple batteries 78. In some embodiments, the battery 78 is a twelve-volt deep cycle battery, and may be used with a twelve-volt, twenty-four-volt, or thirty-six-volt brushed, direct current (DC) electric motor 5. In other embodiments, smaller or larger batteries 78 used with the same or other motors 5 may be implemented. These are just some illustrations of the battery 78 that may be implemented in the mount and control system 1.

In some embodiments, the circuit breaker 80 comprises a fuse that prevents the flow of electrical current from the battery 78 to the motor 5 if, for instance, a threshold amount of current is detected. The circuit breaker 80 may further be implemented in a variety of other configurations with a variety of other components.

In some embodiments, a kill switch 82 may comprise an on/off switch for the electrical subsystem 70. In other embodiments, the kill switch 82 comprises a lanyard or other connection between a kayaker and the kill switch 82 such that the flow of current from the battery 78 to the motor 5 may be quickly and easily stopped. For example, if a kayaker overturns the kayak 3 while in the water, the kill switch 82 may turn off power to and stop the motor 5. In other embodiments, the kill switch 82 comprises a low voltage kill switch that includes a solenoid. In some implementations, the solenoid is a continuous draw solenoid, but it may also be a starter or other type of solenoid. The kill switch 82 may further be implemented in a variety of other configurations with a variety of other components.

FIG. 4 further depicts an embodiment of a motor control subsystem 10. The motor control subsystem 10, discussed in further detail herein, provides, among other things, control over rotation of the motor 5 and thereby control over steering of the kayak 3. To more clearly see some components of the motor control subsystem 10, a section cut 6A-6A is made as shown in FIG. 4. The resulting section view is shown in, and discussed below with reference to, FIGS. 6A and 6B. A view 5-5 is also made as shown in FIG. 4. The resulting view is shown in, and discussed below with reference to, FIG. 5.

Figure 5:
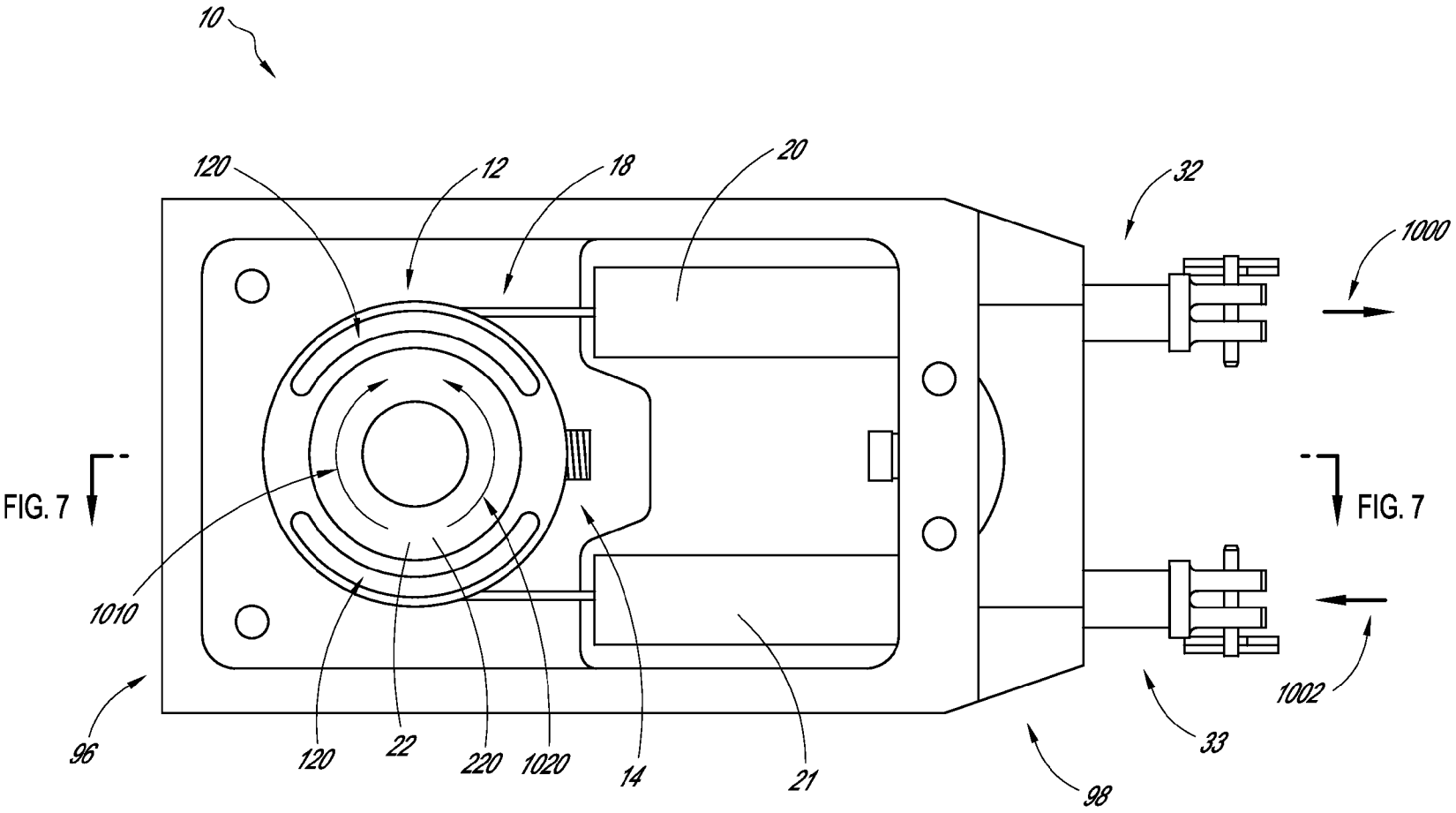
FIG. 5 is a bottom view, taken along line 5-5 in FIG. 4, of the control system, with a lower frame, lower thrust bearing, and upper frame removed to more clearly show internal features.

FIG. 5 is a bottom view of an embodiment of some features of the motor control subsystem 10. Some features, such as the lower frame 94, lower thrust bearing 24, upper frame 92 and wire harness 71 have been removed to more clearly see certain features of the subsystem 10. In some embodiments, the frame 96 and the frame extension 98 comprise two stabilizer pins 32 and 33, two spring tubes 20 and 21, a pulley cable 18, and a pulley 12. As mentioned above, discussion of some features in the present disclosure may apply equally to complementary counterparts. For instance, descriptions with reference to rudder cord 26, stabilizer pin 32, spring tube 20, stabilizer spring 36, and stabilizer bushing 34, etc.—which in some embodiments are located on the left side of the motor control subsystem—may apply equally to their counterparts on the right side of the subsystem, respectively, to rudder cord 25, stabilizer pin 33, spring tube 21, stabilizer spring 37, and stabilizer bushing 35, etc.

In some embodiments, as discussed herein, the rudder cord 26, 25 couples with the stabilizer pin 32, 33. In some embodiments, the stabilizer pin 32, 33 protrudes forward from the frame extension 98. The rearward portion of the stabilizer pin 32, 33, as is discussed in further detail herein, enters an opening in the frame extension 98 and is then received by the spring tube 20, 21. The rearward portion of the stabilizer pin 32, 33 may capture and secure a pulley cable 18, as is also discussed in further detail herein. In some embodiments, the pulley cable 18 leaves the spring tube 20 in the rearward direction and extends over and around a pulley 12, making a substantially one hundred and eighty degree turn. It may then leave the pulley 12 in the forward direction and enter the spring tube 21 as shown, where it may be captured by the stabilizer pin 33. Further detail of these and other features are discussed herein, for example with reference to FIGS. 6A and 6B below.

In some embodiments, the motor control subsystem 10 actuates and controls the rotation of the motor 5 with respect to a rotation axis. In this manner, the subsystem 10 therefore actuates and controls the steering of the kayak 3. Referring to FIG. 5, in some embodiments, the stabilizer pin 32 is pulled forward in direction 1000 by the rudder cord 26. This in turn pulls a portion of the pulley cable 18 in the forward direction 1000, rotating the pulley 12 in the rotation direction 1010, and pulling another portion of pulley cable 18 and the stabilizer pin 33 in the rearward direction 1002. This is merely an overview of some of the processes and dynamic characteristics of some components of an embodiment of the motor control subsystem 10. Further details of these characteristics and this process are discussed herein, for instance with reference to FIGS. 6A and 6B below.

A bottom view of an embodiment of the pulley 12 is shown in FIG. 5. In some embodiments, the pulley 12 comprises pin grooves 120. The pin grooves 120 may receive the stop pins 15, discussed in further detail herein, and assist with preventing over-rotation of the pulley 12 and the motor 5. Further details of the pulley 12 are discussed herein with respect to other figures, for instance FIGS. 9A-9D.

In some embodiments, the motor control subsystem 10 comprises an upper thrust bearing 22. As is discussed in further detail herein, the upper thrust bearing 22 may comprise a shaft bearing surface 220 and a pulley bearing surface 222 (not visible in FIG. 5) with which, respectively, part of the drop-shaft 16 and part of the pulley 12 may be in contact. The shaft bearing surface 220 is visible in FIG. 5 near the center of pulley 12. It is understood that some components of the subsystem 10 have been removed from this view for clarity, for instance the drop-shaft 16 and the lower thrust bearing 24.

In some embodiments, the pulley 12 may receive a set screw 14. The set screw 14 may be threaded in a radial direction into the side of the pulley 12 and capture the drop-shaft 16, as is discussed in further detail herein, for example with respect to FIG. 7.

Figure 6A:
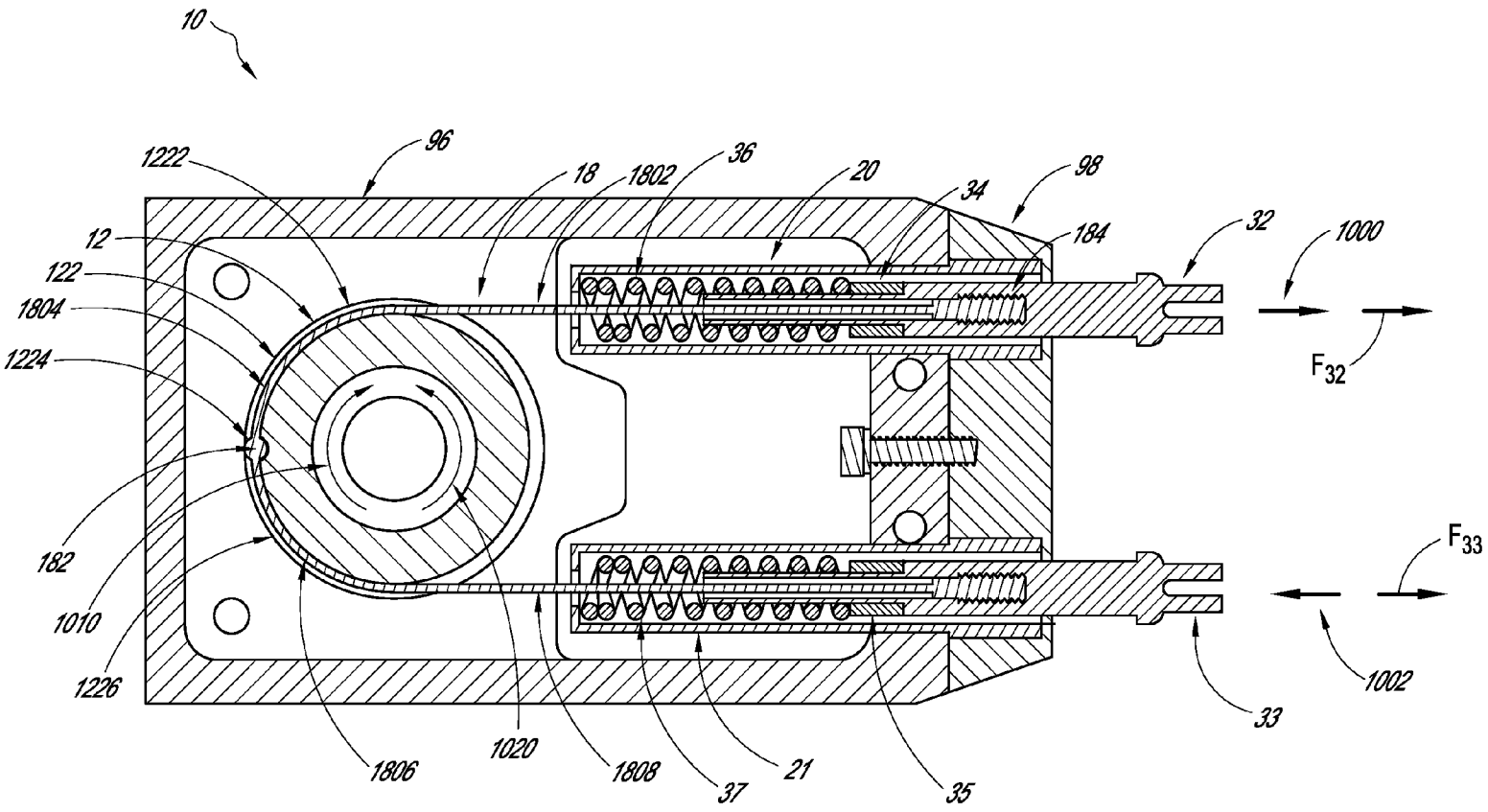
FIG. 6A is a section view taken along line 6A-6A in FIG. 4 and shows the control system in a central position.

FIG. 6A is a section view, taken from FIG. 4, of an embodiment of some features of the motor control subsystem 10. The forward portion, in the direction 1000, comprises the frame extension 98, which is coupled to the frame 96 on the rearward portion. In some embodiments, the frame extension 98 and the frame 96 are separate pieces, as shown, coupled by a fastener. In other embodiments, multiple fasteners may be implemented. The boundaries, or surfaces in contact, between the frame extension 98 and the frame 96 are substantially flat, as shown. However, in other embodiments, the boundaries may be implemented in other configurations without departing from the scope of the present disclosure. In other embodiments, there may be no boundary, for example where the frame extension 98 and the frame 96 are a unitary piece comprising a single part.

In some embodiments, the frame extension 98 and the frame 96 provide a framework or housing for some of the parts of the motor control subsystem 10. The frame extension 98, as shown, receives the two stabilizer pins 32, 33 as well as the two spring tubes 20, 21. The frame 96 also receives the two spring tubes 20 and 21, as shown. The stabilizer pins 32, 33 are further partially housed inside of the spring tubes 20, 21. In some embodiments, as depicted in FIG. 6A, the spring tubes 20 and 21 have a larger outer diameter section, discussed in further detail herein, that is aligned by the frame extension 98 and that partially bears on the frame 96. A smaller diameter section of the spring tubes 20,21, is aligned by slots in the frame 96. The forward portion of the spring tubes 20, 21 is further bearing against a bore in the frame extension 98. In other embodiments, the spring tubes 20, 21 as well as the stabilizer pins 32, 33 may be implemented in a variety of configurations that are within the scope of the present disclosure. The embodiments addressed herein are illustrations of some implementations of those embodiments. For instance, in some embodiments, the spring tubes 20, 21 may penetrate through the frame extension 98. In other embodiments, the spring tubes 20, 21 may not extend past the forward most portion of the frame 96 and therefore not be received by the frame extension 98 at all. In other embodiments, the spring tubes 20, 21, the frame 96, and/or the frame extension 98 are a unitary piece. Therefore, other configurations and variations of the motor control subsystem 10 may be implemented that are within the scope of the present disclosure.

Some embodiments of the motor control subsystem 10 comprise stabilizer springs 36, 37. The stabilizer springs 36, 37 store and provide mechanical energy in the mount and control system 1 that, among other things, assist with controlling the motor 5 and provide varying levels of responsiveness to the system 1, as discussed in further detail herein. As shown, the stabilizer springs 36, 37 may be compressive coil or helical springs made of stainless steel. While some embodiments may use coil springs in compression, it is understood that other springs in other configurations may be implemented in the system 1 and are within the scope of the present disclosure. For instance, in some embodiments stabilizer springs 36 and 37 may be extension springs that are configured to store energy in tension, or as they extend. In other embodiments, the stabilizer springs 36, 37 may be constant force springs, variable springs, cantilever springs, torsion springs, extension springs, conical springs, leaf springs, Belleville springs, Negator springs, wave springs, tension springs, or any other type of mechanical device capable of storing mechanical energy, either in compression, tension, torsion, etc. Therefore, a variety of configurations may be implemented using a variety of spring and/or spring-like devices and parts.

In some embodiments, the stabilizer springs 36, 37 as well as the stabilizer bushings 34, 35 are housed inside the spring tubes 20, 21. The stabilizer bushings 34, 35, as discussed in further detail herein, are in some embodiments hollow, cylindrical parts with openings at both ends. The stabilizer springs 36, 37 may bear against surfaces of the spring tubes 20, 21 and of stabilizer bushings 34, 35. For example, the stabilizer spring 36 is housed inside the spring tube 20. The rearward end, in the direction 1002, of the stabilizer spring 36 bears against an inside surface of spring tube 20, while the forward end of the stabilizer spring 36 bears against a rearward end of the stabilizer bushing 34. The forward portion of the stabilizer bushing 34 bears against the rearward end of the larger diameter section of the stabilizer pin 32. A smaller diameter section of the stabilizer pin 32 extends through the inside of the stabilizer bushing 34 and the inside of the stabilizer spring 36. As mentioned, it is understood that descriptions related to one side of the motor control subsystem 10 may apply equally to the other side. For instance, the preceding example applies equally to the spring tube 21, the stabilizer spring 37, the stabilizer bushing 35 and the stabilizer pin 33.

The stabilizer bushings 34, 35 provide bearing surfaces for the stabilizer springs 36, 37, assist with alignment of the stabilizer pins 32, 33, and reduce torsional energy build-up in the stabilizer springs 36, 37. In some embodiments, for instance, the stabilizer bushing 34 transmits a force or load applied by the stabilizer spring 36 to the stabilizer pin 32. The line of action of this force may be viewed in the forward direction 1000 as follows: from the rearward, inside surface of spring tube 20, to the rearward portion of stabilizer spring 36, to the forward portion of stabilizer spring 36, to the rearward portion of stabilizer bushing 34, to the forward portion of stabilizer bushing 34, to the larger outer diameter section of stabilizer pin 32. As the force may be a compressive force, this line of action may likewise be viewed in the reverse direction. It is understood that descriptions related to one side of the motor control subsystem 10 may apply equally to the other side. For instance, the preceding example applies equally to spring tube 21, stabilizer spring 37, stabilizer bushing 35 and stabilizer pin 33.

As mentioned, the stabilizer bushings 34, 35 may assist with alignment of the stabilizer pins 32, 33. As shown in FIG. 6A, in some embodiments the outer diameter of, for example, the stabilizer bushing 34 bears against the inner diameter of the spring tube 20. Further, the inner diameter of the stabilizer bushing 34 bears against the (smaller) outer diameter section of the stabilizer pin 32. Therefore, in this manner the spring tube 20 assists with aligning the stabilizer bushing 34, which in turn assists with aligning the stabilizer pin 32. It is understood that descriptions related to one side of the motor control subsystem 10 may apply equally to the other side. For instance, the preceding example applies equally to spring tube 21, stabilizer spring 37, stabilizer bushing 35 and stabilizer pin 33.

As mentioned, the stabilizer bushings 34, 35 further may reduce torsional energy build-up in the stabilizer springs 36, 37. For instance, in some embodiments, rotation by the stabilizer spring 36 will transmit a rotational force to the stabilizer bushing 34 via friction forces. Therefore, if rotational or torsional energy builds up in the stabilizer spring 34, it will be transmitted to the stabilizer bushing 34. However, the stabilizer bushing 34 is free to rotate about the small diameter section of stabilizer pin 32. Thus, if this torsional energy exceeds a threshold limit, then the stabilizer bushing 34 will rotate and dissipate some or all of the torsional energy in the stabilizer spring 34, via friction, heat, etc. It is understood that descriptions related to one side of the motor control subsystem 10 may apply equally to the other side. For instance, the preceding example applies equally to spring tube 21, stabilizer spring 37, stabilizer bushing 35 and stabilizer pin 33.

As discussed in further detail herein, the two ends of the pulley cable 18 may include a threaded stud 184. In some embodiments, the stabilizer pins 32, 33 each capture the threaded studs 184 on the ends of a pulley cable 18. In some embodiments of the motor control subsystem 10, the threaded stud 184 is coupled to the stabilizer pin 32 and another threaded stud 184 on the opposite end of the cable 18 is coupled to the stabilizer pin 33. With respect to the stabilizer pin 32, for example, as depicted in FIG. 6A, the threaded stud 184 may be captured by an internally threaded portion inside the larger outer diameter section of the stabilizer pin 32. As is discussed in further detail herein, the stabilizer pins 32, 33 in some embodiments may comprise a bore that includes this internally threaded portion. In some embodiments, for example, the threaded stud 184 is coupled to the stabilizer pin 32 by rotating the threaded stud 184 into the internally-threaded portion of the stabilizer pin 32. Likewise, the threaded stud 184 may be removed from the stabilizer pin 32 by rotating the threaded stud 184 in the opposite direction and therefore out of the internally-threaded portion of stabilizer pin 32. Other couplings between the pulley cable 18 and stabilizer pins 32, 33 may be implemented that are within the scope of the present disclosure. For instance, the pulley cable may have studs 184, threaded or otherwise, that couple to the stabilizer pins 32, 33 by snapping, by adhering, by interference fitting, or by coupling with a third member such as a through-bar. Many other means of coupling the pulley cable 18 to the stabilizer pins 32, 33 will be readily apparent to those with ordinary skill in the art.

Some embodiments of the motor control subsystem 10 also comprise the pulley cable 18 that couples with the pulley 12. As further shown in FIG. 6A, the pulley cable 18 may comprise a first cable segment 1802, a second cable segment 1804, a pulley catch 182, a third cable segment 1806, and a fourth cable segment 1808. In some embodiments, the various cable segments are all part of the same pulley cable 18. In other embodiments, some or all of the cable segments are separate cable segments coupled together to form the pulley cable 18. Further details of the pulley cable 18 are discussed herein, for example with respect to FIG. 11. As shown, some of a substantially straight first cable segment 1802 of pulley cable 18 may be inside the stabilizer pin 32, the stabilizer spring 36, and the spring tube 20. The end of the pulley cable 18 inside of the stabilizer pin 32 may include the threaded stud 184, as mentioned. This first cable segment 1802 may extend from this threaded stud 184, inside the stabilizer pin 32, into a stabilizer spring 36, through an end of spring tube 20, and up to a first groove segment 1222 of cable groove 122 on pulley 12. A second cable segment 1804 of pulley cable 18 may then couple onto and around the first groove segment 1222 of the cable groove 122. Following the first groove segment 1222 may be an intermediate groove segment 1224 of cable groove 122. The intermediate groove segment 1224 may couple with the pulley catch 182, discussed in further detail herein, of pulley cable 18. Then, the third cable segment 1806 of the pulley cable 18 may couple onto and around the second groove segment 1226 of the cable groove 122. The substantially straight fourth cable segment 1808 may then extend from the second groove segment 1226 of the cable groove 122 of the pulley 12, through an end of the spring tube 21, into the stabilizer spring 37, inside the stabilizer pin 33, and into the threaded stud 184, which is coupled to the stabilizer pin 33.

While the description of the various segments and portions of, for example, the control pulley 12 and the pulley cable 18 may be discussed in a spatial order with respect to certain figures, no order is implied in the configuration or implementation of those features. The orders of any descriptions are made with reference to an embodiment and should not be read to limit the scope of the present disclosure. For instance, the preceding example may be read to "begin" with the stabilizer pin 32 and "end" with the stabilizer pin 33, however no such order is implied or meant to be applied to the present disclosure. A similar description could have "begun" with the stabilizer pin 33 and "ended" with the stabilizer pin 32. Therefore, any apparent "order" or "direction" of this or any other description is merely done to illustrate certain embodiments and does not limit the scope of the disclosure. Further, it is understood that the "first" and "second" cable segments etc. of the pulley cable 18 refer to locations on the pulley cable 18 when configured in the motor control subsystem 10. Therefore, a section of the pulley cable 18 may in one configuration be referred to as a "second segment" while in another configuration the same section may be a "first segment." For instance, the second cable segment 1804 may leave the pulley 12 and thereafter become the first cable segment 1802, etc.

In some embodiments, as mentioned herein, the motor control subsystem 10 actuates and controls the rotation of the motor 5 with respect to a substantially vertical axis. In this manner, the subsystem 10 therefore actuates and controls the steering of the kayak 3. As mentioned, the rotating of the motor 5 may begin with pushing forward on the foot pegs 284, 285. For instance, referring to FIGS. 1-2B, pushing forward on the foot peg 284 on the left side of the cockpit 9 will pull the left-side stabilizer pin 32 forward, which results in a rotation of the motor 5 that steers the kayak 3 to the left. Similarly, pushing forward on the foot peg 285 on the right side of the cockpit 9 will pull the right-side stabilizer pin 33 forward, which results in a rotation of the motor 5 that steers the kayak 3 to the right. In other embodiments, the relationship between foot peg and steering may be reversed. For instance, in other embodiments, the right side foot peg 285 may steer the kayak 3 to the left and the left side foot peg 284 may steer the kayak 3 to the right. The resulting direction of rotation of the motor 5 for a given foot peg input will depend on the particular configuration of the present disclosure. While an embodiment is described in detail with respect to a particular configuration, it applies equally to other possible configurations.

Referring to FIG. 6A, movement of the stabilizer pins 32, 33 transmits and induces forces and motions to the rearward portion of the motor control subsystem 10, comprising, among other things, the stabilizer springs 36, 37, the spring tubes 20, 21, the pulley cable 18 and the pulley 12. In some embodiments, as mentioned, the stabilizer pin 32 is pulled forward in the direction indicated by direction 1000. Because the stabilizer pin 32 bears against the stabilizer bushing 34 which bears against the compressed stabilizer spring 36, moving the stabilizer pin 32 in direction 1000 will therefore, among other things, de-compress the stabilizer spring 36 and thereby release some of the stored mechanical energy in the stabilizer spring 36. Further, moving the stabilizer pin 32 in direction 1000, in turn, will pull in direction 1000 the first cable segment 1802 of the pulley cable 18 that is captured by the stabilizer pin 32. Pulling on the first cable segment 1802 in direction 1000 causes a second cable segment 1804, that is partially wrapped around the pulley 12, to rotate in the direction indicated by the rotation direction 1010.

Coupled to the end of the second cable segment 1804 is the pulley catch 182. The pulley catch 182 is coupled to the catch recess 124 of the pulley 12 such that rotation of the second cable segment 1804, in the direction indicated by direction 1010, causes the pulley 12 to rotate in the direction 1010. As is discussed in further detail herein, the pulley catch 182 in some embodiments is a spherical swage on the pulley cable 18 that fits into a semi-spherical recess 124 of the pulley 12. Pulling on the second cable segment 1804 pulls on the pulley catch 182, which transmits a force to the recess 124 of the pulley 12. This force is in the direction of the second cable segment 1804, or to the left direction 1004, and is substantially tangential to the outer surface of the pulley 12 at the location of the recess 124. This force creates a moment about the center of the pulley 12 that causes the pulley 12 to rotate in the direction 1010. Rotation of the pulley 12 is then transmitted to the drop-shaft 16 via the set screw 14, as is discussed in further detail herein, which rotates the motor 5 and steers the kayak 3. In some embodiments, rotation of the pulley in direction 1010 rotates the drop-shaft 16 and therefore the motor 5 in direction 1010 as well. In other embodiments, rotation of the pulley in the direction 1010 rotates the drop-shaft 16 and therefore the motor 5 in the rotation direction 1020.

The pulley catch 182 is further coupled to a third cable segment 1806 that may likewise be rotated in the rotation direction 1010. Rotation of the third cable segment 1806 pulls the fourth cable segment 1808 in the rearward direction 1002. The fourth cable segment 1808 is coupled to the threaded stud 184 that is coupled to the stabilizer pin 33, such that pulling the fourth cable segment 1808 in the rearward direction 1002 transmits this force to the stabilizer pin 33 and pulls the pin 33 in the direction 1002. Pulling the stabilizer pin 33 in the direction 1002 causes the stabilizer pin 33 to bear against and transmit a force to the stabilizer bushing 35, which bears against and transmits a force to the stabilizer spring 37, which bears against and transmits a force to the inside surface of the spring tube 21. In this manner, rotating the pulley catch 182 in the direction 1010 transmits a compressive force to the stabilizer spring 37 in the direction 1002, causing the stabilizer spring 37 to compress, thereby storing more mechanical energy in the stabilizer spring 37.

Therefore, in some embodiments, pulling the stabilizer pin 32 in the direction 1000 will result, among other things, in the following: the stabilizer spring 36 lengthening in the forward direction 1000 and releasing stored mechanical energy; the pulley 12 and therefore the motor 5 rotating in the rotation direction 1010; the stabilizer pin 33 moving in the direction 1002; and the stabilizer spring 37 compressing in length in the rearward direction 1002 and increasing in stored mechanical energy.

Figure 6B:
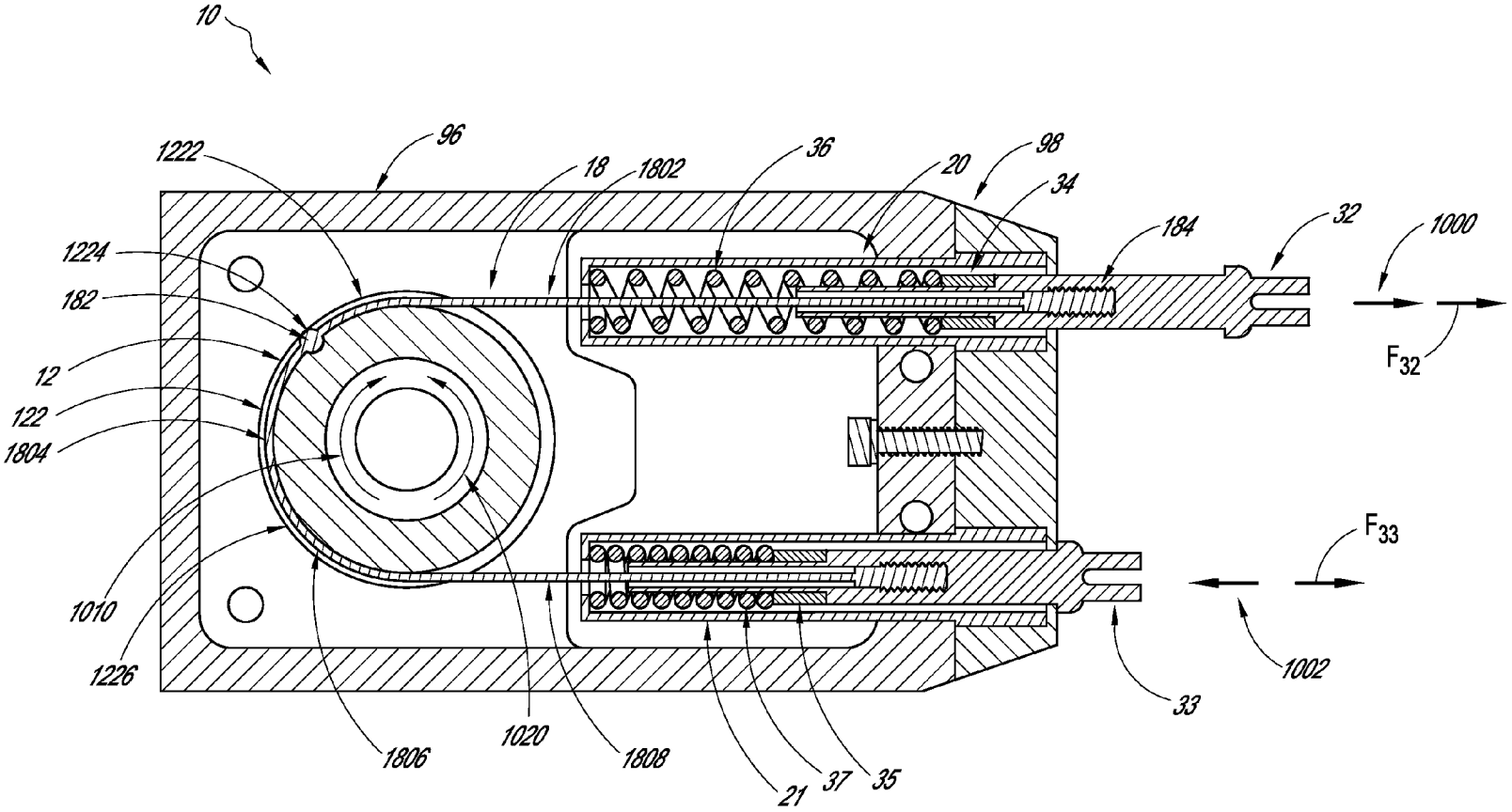
FIG. 6B is similar to FIG. 6A except the control system has been actuated to rotate the motor.

An embodiment of the preceding configuration is shown, for example, in FIG. 6B. As shown, and as compared to the configuration shown in FIG. 6A, the stabilizer pin 32 has translated in the forward direction 1000, the stabilizer spring 36 has de-compressed and lengthened in the forward direction 1000, the pulley 12 has rotated in the rotation direction 1010, the stabilizer spring 37 has compressed and shortened in the rearward direction 1020, and the stabilizer pin 33 has translated in the rearward direction 1002. Further, the pulley catch 182 of the pulley cable 18, as well as the catch recess 124 at the intermediate groove segment 1224 of the pulley 12, have rotated a similar amount in the rotation direction 1010.

In this embodiment in the configuration shown in FIG. 6B, the stored mechanical energy of the stabilizer spring 37 is increased and the stored mechanical energy of the stabilizer spring 36 is decreased, as compared to the neutral configuration shown in FIG. 6A. However, in other embodiments, the stored mechanical energy of the stabilizer spring 37 may be decreased and the stored mechanical energy of the stabilizer spring 36 may be increased in the configuration of FIG. 6B as compared to the neutral configuration shown in FIG. 6A. For example, if extension springs are implemented, this energy relationship may apply. Therefore, the embodiment shown in FIGS. 6A and 6B are merely for illustration of an implementation and do not limit the scope of the present disclosure.

In some embodiments, the motor control subsystem 10 may maintain the configuration shown in FIG. 6B with an external force applied in the forward direction 1000 to the stabilizer pin 32. As mentioned, an embodiment of a neutral configuration of the motor control subsystem 10 as shown in FIG. 6B may result in an increase in the stored mechanical energy of the stabilizer spring 37. This increased energy results in an increased force applied by the stabilizer spring 37 to the stabilizer bushing 35 in the forward direction 1000, which transmits this force to the stabilizer pin 33. An external force applied to the stabilizer pin 33 in the forward direction 1000 will, as mentioned, create a moment about the pulley 12 in the rotation direction 1020. Therefore, when the subsystem 10 is in the configuration shown in FIG. 6B, it will create a moment about the pulley 12 in the rotation direction 1020. For the subsystem 10 to maintain this position, i.e. for the motor 5 to maintain the rotated position resulting from this configuration, an equal and opposite second moment must be present. That is, a second moment about the pulley 12 that is equal in magnitude but opposite in direction of that created by the compressed stabilizer spring 37 must be applied. In some embodiments, this second moment is provided in part by an external force applied in the forward direction 1000 to the stabilizer pin 32. Thus, in some embodiments, the motor control subsystem 10 may maintain the configuration shown in FIG. 6B with a force applied in the forward direction 1000 to stabilizer pin 32 that is approximately similar to the force applied by the compressed stabilizer spring 37 in the forward direction 1000 to stabilizer bushing 35.

In some embodiments, in the configuration shown in FIG. 6B, the motor 5 has rotated in the rotation direction 1010 and the kayak 3 has thereby been steered toward the left direction 1003. The motor 5 may be rotated in the rotation direction 1020, and the kayak 3 therefore steered toward the right direction 1001, by translating the stabilizer pin 33 in the forward direction 1000. Translating the stabilizer pin 33 in the forward direction 1000 will, for similar reasons given above, de-compress and thereby release some of the stored mechanical energy of stabilizer spring 37. Further, moving the stabilizer pin 33 in the forward direction 1000, in turn, will pull in the direction 1000 the fourth cable segment 1808 of the pulley cable 18 that is captured by the stabilizer pin 33. Pulling on the fourth cable segment 1808 in the direction 1000 causes the third cable segment 1806, that is partially wrapped around the pulley 12, to rotate in the rotation direction 1020.

Coupled to the end of the third cable segment 1806 is the pulley catch 182. The pulley catch 182 is coupled to the catch recess 124 of the pulley 12 such that rotation of the second cable segment 1804, in the rotation direction 1020, causes the pulley 12 to rotate in the rotation direction 1020. As is discussed in further detail herein, the pulley catch 182 in some embodiments is a spherical swage on the pulley cable 18 that fits into a semi-spherical recess 124 of the pulley 12. Pulling on the third cable segment 1806 pulls on the pulley catch 182, which transmits a force to the recess 124 of the pulley 12. This force is in the direction of the third cable segment 1806, or to the right direction 1005, and is substantially tangential to the outer surface of the pulley 12 at the location of the recess 124. This force creates a moment about the center of the pulley 12 that causes the pulley 12 to rotate in the rotation direction 1020. Rotation of the pulley 12 is then transmitted to the drop-shaft 16 via the set screw 14, which in some embodiments rotates the motor 5 in the rotation direction 1020 and steers the kayak 3 toward the right.

In the configuration shown in FIG. 6B, translation of the stabilizer pin 32 in the forward direction 1000 may result from a force $F_{32}$ applied to the stabilizer pin 32 in the forward direction 1000 that is sufficiently greater than a force $F_{33}$ applied to the stabilizer pin 33 in the forward direction 1000. This creates a net moment about the pulley 12 that tends to rotate the pulley 12 in the rotation direction 1010. In some embodiments, the force $F_{32}$ may become sufficiently greater than the force $F_{33}$ by increasing the magnitude of the force $F_{32}$ For example, if pressure is applied to foot peg 285 to create the force $F_{33}$ applied to the stabilizer pin 33, then a pressure may be applied to the foot peg 284 to create the force $F_{32}$ applied to the stabilizer pin 32 that is greater than force $F_{33}$.

In other embodiments, the force $F_{33}$ may become sufficiently greater than the force $F_{32}$ by decreasing the magnitude of the force $F_{32}$. For example, if forward pressure is applied to the foot peg 284 to create the force $F_{32}$ applied to the stabilizer pin 32, then this pressure applied to the foot peg 284 may be decreased, such that it is then sufficiently less than force $F_{33}$, i.e. $F_{33}$ is now sufficiently greater than $F_{32}$. As mentioned, in the configuration shown in FIG. 6B, the stabilizer spring 37 is compressed and applies a force to the stabilizer pin 33 in the forward direction 1000. By decreasing the pressure on the foot peg 284 the force applied by stabilizer pin 33 translates the stabilizer pin 33 in the forward direction 1000. In this manner, decreasing the pressure on the foot peg 284, when the motor control subsystem is in the configuration shown in FIG. 6B, translates the stabilizer pin 33 in the forward direction 1000 which rotates the motor 5 in the rotation direction 1020, thereby steering the kayak 3 toward the right.

Therefore, in some embodiments, the motor control subsystem 10 may be configured in a neutral position, for example as shown in FIG. 6A, and then re-configured in a rotated position, for example as shown in FIG. 6B. In some embodiments, the neutral position of FIG. 6A will result in a neutral position of the motor 5 such that the kayak 3 substantially steers straight or in the forward direction 1000, and the rotated position of FIG. 6B will result in a rotated position of the motor 5 such that the kayak 3 steers toward the left. In other embodiments, the rotated position of FIG. 6B may result in a rotated position of the motor 5 such that the kayak 3 steers toward the right. Further, the motor control subsystem 10 may be configured such that either the stabilizer pin 32 is translated in the forward direction 1000 while the stabilizer pin 33 is translated in the rearward direction 1002, or the stabilizer pin 32 may be translated in the rearward direction 1002 while the stabilizer pin 33 is translated in the forward direction 1000. Therefore, the pulley 12 may be rotated in the rotation direction 1010 or in the rotation direction 1020, and the motor 5 may therefore steer the kayak 3 to the right or left.

The detailed description of rotation of the pulley 12 in one direction applies equally to the rotation of the pulley 12 in the opposite direction. For instance, in some embodiments, as compared to the neutral configuration of FIG. 6A, another configuration of a rotated position of motor control subsystem 10 may comprise the stabilizer pin 33 translated in the forward direction 1000, the stabilizer pin 32 translated in the rearward direction 1002, and the pulley 12 and the pulley cable 18 rotated in the rotation direction 1020. It is further understood that the dynamic characteristics described herein with respect to FIGS. 6A and 6B apply equally but in the opposite sense to a motor control subsystem 10 rotated in the rotation direction 1020. For example, where the configuration of FIG. 6B may be maintained by an external Force $F_{32}$ applied to the stabilizer pin 32 in the direction 1000 that is sufficiently greater than an external Force $F_{33}$ applied to the stabilizer pin 33 in the direction 1000, the aforementioned configuration with rotations in the direction 1020 may be maintained by an external Force $F_{33}$ applied to stabilizer pin 33 in the direction 1000 that is sufficiently greater than an external Force $F_{32}$ applied to stabilizer pin 32 in the direction 1000, etc.

In some embodiments, the motor control subsystem 10 provides a stable control system. Stable here refers to the tendency of the motor control subsystem 10 to rotate the pulley 12 toward a neutral configuration, for example a configuration as shown in FIG. 6A. In some embodiments, if no pressure is applied to either foot peg 284, 285, no force will be applied by the rudder cords 26, 25 to the stabilizer pins 32, 33, respectively. Therefore, the forces from the stabilizer springs 36, 37 will act on the stabilizer pins 32, 33 without external forces by the rudder cords 25, 26. As mentioned, in the configuration shown in FIG. 6B, the stabilizer spring 37 is compressed and applies the force $F_{33}$ to the stabilizer pin 33 in the forward direction 1000. Further, the stabilizer spring 36 is compressed less than stabilizer spring 37, and therefore applies the force $F_{32}$ to the stabilizer pin 32 in the forward direction 1000 that is less than the force $F_{33}$. Therefore, in the absence of forces on the stabilizer pins 32, 33 by rudder cords 25 and 26, the larger force applied by stabilizer spring 37 will tend to rotate the pulley 12 in the rotation direction 1020. As the stabilizer spring 37 rotates the pulley 12 in the rotation direction 1020, the stabilizer pin 33 will translate in the forward direction 1000, thereby de-compressing the stabilizer spring 37, which decreases the force applied by the stabilizer spring 37 on the stabilizer pin 33 in the forward direction 1000. Further, as the stabilizer spring 37 rotates the pulley 12 in the rotation direction 1020, the stabilizer pin 32 will translate in the rearward direction 1002, thereby further compressing the stabilizer spring 36, which increases the force applied by the stabilizer spring 36 on the stabilizer pin 32 in the forward direction 1000. In some embodiments, when the rotation of the pulley 12 reaches the position shown in FIG. 6A, the stabilizer springs 36 and 37 have substantially similar compressed lengths. In some implementations, the stabilizer springs 36, 37 have substantially similar spring constants, such that compression or deflection of each by the same distance relative to their natural lengths results in substantially the same stored energy and exerted force. Natural length here refers to the length of the springs with no external force applied to them. Therefore, in some embodiments, when the motor control subsystem 10 is in the configuration shown in FIG. 6A, the forces applied by the stabilizer springs 36 and 37 will be substantially equal. The stabilizer pins 32, 33 will therefore remain in their shown translated positions, and the pulley 12 will remain in the shown rotated position. The motor 5 that is coupled to the pulley 12 will therefore be in a substantially straight configuration such that the kayak 3 steers substantially straight.

A variety of features in the mount and control system 1 may be implemented in various configurations to account for variations in the dimensions of some features and/or variations in the forces resulting therefrom. In some embodiments, the length of the pulley cable 18 may be adjusted in order to maintain the proper forces in the neutral configuration as shown, for example, in FIG. 6A. In other embodiments, the interface between the threaded studs 184 and the stabilizer pins 32, 33 may be adjusted, for instance, with locking threads that allow for less than full rotational engagement. In some embodiments, the stabilizer springs 36, 37 may be replaced or adjusted, for example, to have different lengths, thicknesses, diameters, turns per unit length, material, etc. In some embodiments, the stabilizer bushings 34, 35 may have different lengths, thicknesses, materials, etc. In other embodiments, the stabilizer pins 32, 33 may have variable lengths, materials, etc. In additional embodiments, the lengths and/or paths of the cords 27, 29 or the rudder cords 25, 26 may be adjusted. For instance, the cords 27, 29 and/or the rudder cords 25, 26 may be routed to take a longer or shorter path from the foot pegs 284, 285 to the stabilizer pins 32, 33. In some embodiments, the placement of the foot pegs 284, 285 and/or rails 286, 287 may be adjusted. These are just some of the modifications or adjustments to the system 1 that be implemented, for example, to account for variations in lengths and or induced forces by the system 1. Other embodiments and implementations may be incorporated that are within the scope of the present disclosure.

Figure 7:
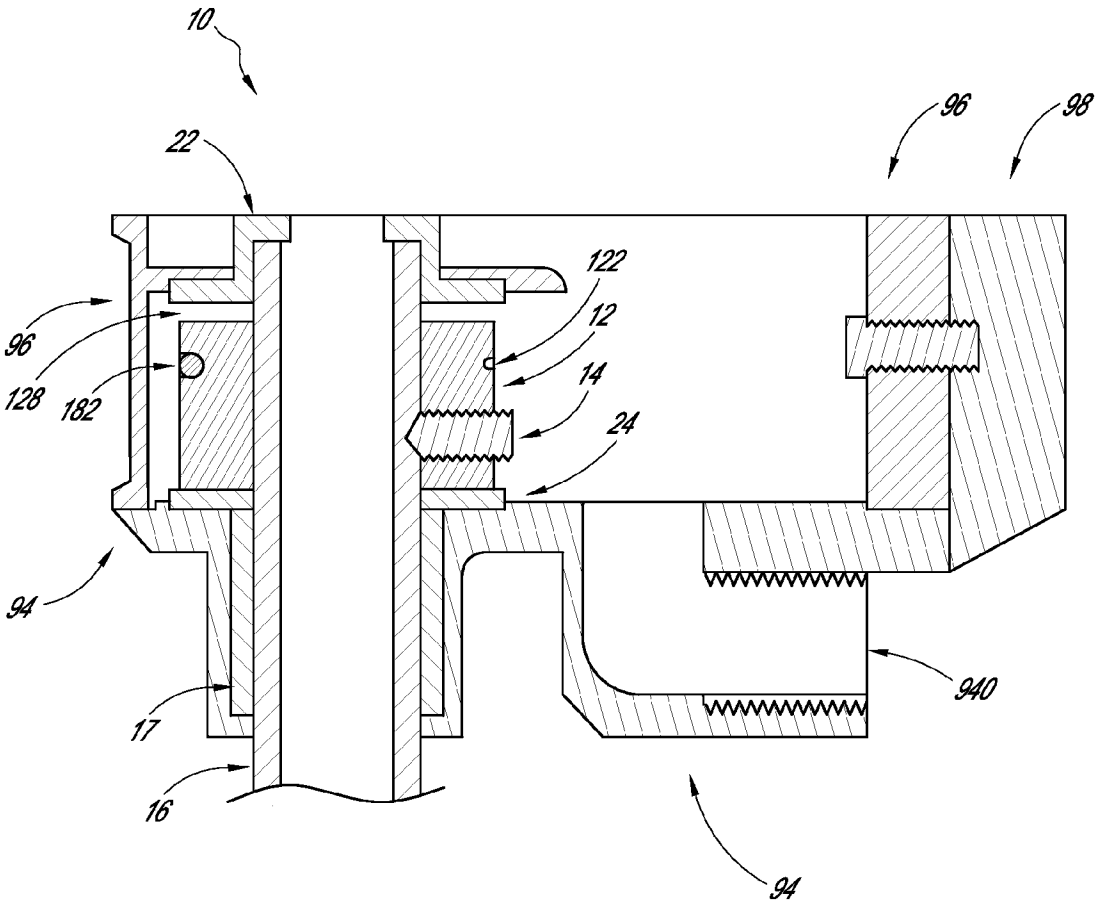
FIG. 7 is a section view taken along line 7-7 in FIG. 5 and shows certain features of the control system.

FIG. 7 is a section view of some parts of the control subsystem 10 of FIG. 5, with section views of additional parts added. In some embodiments, as shown, the lower frame 94, the frame 96, and the frame extension 98 house the upper thrust bearing 22, the pulley 12, the set screw 14, the lower thrust bearing 24, the lower drop-shaft bushing 24, and the drop-shaft 16. The upper thrust bearing 22 is configured in a recess in the frame 96 and receives an end of the drop-shaft 16. The pulley 12 is below the upper thrust bearing 22 and also receives the drop-shaft 16 through the pulley's 12 center hole.

The pulley 12 comprises a circumferential intermediate groove segment 1224 of the cable groove 122 that receives the pulley catch 182 of the pulley cable 18. The pulley 12 further radially receives a the set screw 14. Beneath the pulley 12 is the lower thrust bearing 24. The spacing between the lower thrust bearing 24 and the upper thrust bearing 22 is larger than the height of the pulley 12 such that is provides a pulley gap 128. As shown, the pulley gap 128 is between the upper thrust bearing 22 and the pulley 12, however the pulley 12 may translate vertically as shown into the gap, thereby creating some or all of the gap 128 on the lower side of the pulley 12. The lower thrust bearing 24 sits in a recess in the lower frame 94 and receives the drop-shaft 16. Beneath the lower thrust bearing 24 is the lower drop-shaft bushing 17 that bears against an interior surface of the lower frame 94.

As shown in FIG. 7, the set screw 14 rigidly couples to the pulley 12 and to the drop-shaft 16. Therefore, when the pulley 12 is rotated, the set screw 14 transmits this rotation to the drop-shaft 16. In this manner, rotation of the pulley 12 will rotate the drop-shaft 16, which in turn rotates the motor 5. The set screw 14 is shown on the forward side of the pulley 12, however, it may be implemented in a variety of other locations, for instance the rearward side of the pulley 12. In some embodiments, the set screw 14 comprises a recess on the end, by which a tool, such as a screw driver or hex socket, may be used to rotate and thereby insert or remove the set screw 14 into or out of the pulley 12. The set screw 14 and its features may further be implemented in a variety of other configurations, and the discussion of some implementations herein does not limit the scope of the disclosure. For instance, while a set screw is a known part in the mechanical arts, other devices and parts performing the same or similar function of a set screw may be used in the present disclosure. Other devices or parts that may be used in place of a set screw include, but are not limited to, bolts, tabs, inserts, bars, locking members, fasteners, etc.

An embodiment of the lower frame 94 showing the threaded end 940 is depicted in FIG. 7. The threaded end 940 in some embodiments receives the wire tunnel 56 and the wire harness 71. the wire tunnel 56 may couple with the threaded portion of the threaded end 940 of the lower frame 94 as shown, and the wire harness 71 may extend through the threaded end 940 and up into the frame 96.

The lower drop-shaft bushing 17 is depicted in FIG. 7 between the lower frame 94 and the drop-shaft 16. The bushing 17 decreases rotational friction between the drop-shaft 16 and the lower frame 94. The lower end of the bushing 17 as depicted bears against a flange in the lower frame 94. The other end of the bushing 17 provides a bearing surface for the lower thrust bearing 24. In some embodiments, the bushing 17 is a composite material, although it may be a variety of different materials, including metallic, ceramic, plastic, etc. In some embodiments, the bushing 17 has a cylindrical shape with a hollow interior.

Figure 8B:
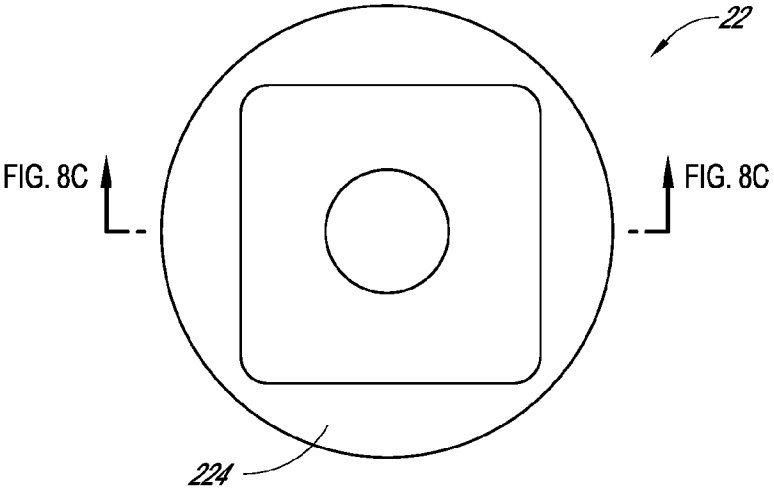
FIGS. 8A-8C are views of an upper thrust bearing from FIG. 7.
Figure 8A:
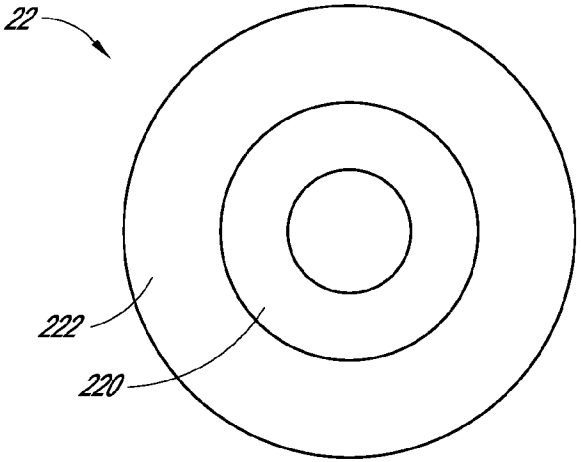
Figure 8C:
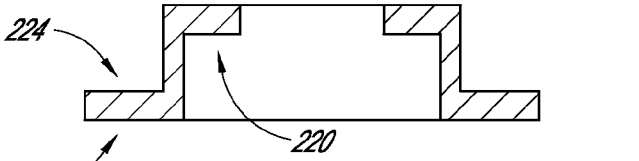

FIGS. 8A-8C are various views of the upper thrust bearing 22. FIG. 8A is a bottom view, FIG. 8B is a top view, and FIG. 8C is a section view. The upper thrust bearing 22 provides bearing surfaces for the pulley 12 and the drop-shaft 16. In some embodiments, the pulley 12 bears against the pulley bearing surface 222 and the drop-shaft 16 bears against the drop-shaft bearing surface 220. A frame bearing surface 224 bears against the frame 90 in a recess as shown, for example, in FIG. 7. The upper thrust bearing 22 in some embodiments is cylindrical, created in part by a "Z" section rotated about a central axis. However, a top portion of the upper thrust bearing 22 in some embodiments, as shown for example in FIG. 8B, has a square shape with a central circular hole. The square shape of the top portion of the upper thrust bearing 22 may assist with preventing rotation. The section view of FIG. 8C shows a section of the upper thrust bearing 22 taken as shown in FIG. 8B. In some embodiments, the upper thrust bearing 22 has the configuration as shown and is a rubber material. In other embodiments, it may be implemented in a variety of configurations and materials, for example a rounded top section and/or made from metal, ceramic, composite, plastic, etc.

FIGS. 9A-9D are various views of the control pulley 12. As discussed in further detail herein, the control pulley 12, among other things, transmits the linear motion of, for example, the foot pegs 284, 285, into rotational motion of, for example, the motor 5. As mentioned, the pulley 12 is housed inside the frame assembly 90.

In some embodiments, the pulley 12 may comprise the cable groove 122, the set screw hole 126, the catch recess 124, and the pin grooves 120. The cable groove 122 may run the circumference of the pulley 12 and capture some segments of the pulley cable 18. The groove 122 may extend completely around the pulley 12, for example 360 degrees, or it may be less than 360 degrees. In some embodiments, the cable groove 122 comprises the catch recess 124. The catch recess 124 captures the pulley catch 182 on the pulley cable 18. The catch recess 124 in some embodiments is a semi-spherical recess in the radial direction. In other embodiments, it may be a bore hole, a square hole, a through hole, or any number of other configurations that may capture the pulley catch 182.

Figure 9C:
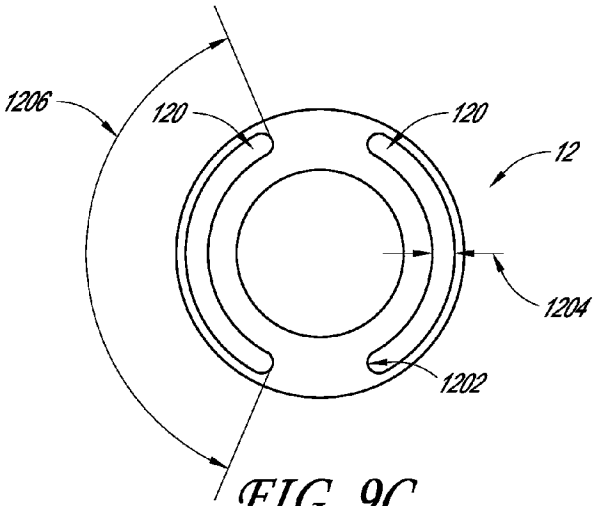
FIGS. 9A-9D are views of a control pulley from FIG. 5.
Figure 9D:
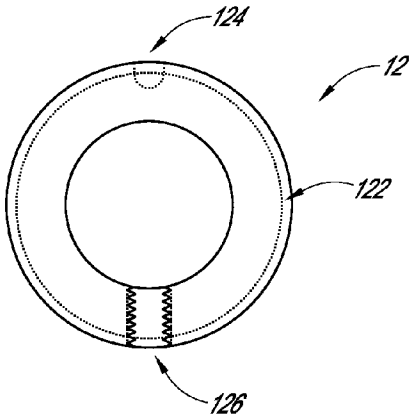
Figure 9A:
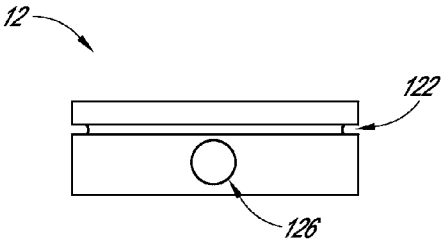
Figure 9B:
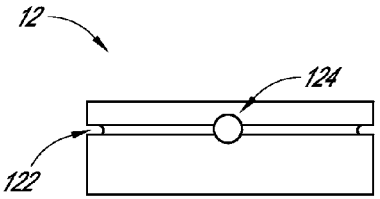

The set screw hole 126, as shown for example in FIG. 9D, is a hole that extends from the exterior of the pulley 12 and protrudes through the interior surface. The set screw hole 126 receives the set screw 14. The set screw hole 126 transfers the rotational motion of the pulley 12 to the drop-shaft 16. The hole 126 is in a different plane than the cable groove 122 and catch recess 124 such that the hole 126 and the set screw 14 do not interfere with these other features of the pulley 12. However, the hole 126 may also be in the same or an overlapping plane as the hole 126 or groove 122. In some embodiments, the set screw hole 126 is an internally-threaded hole that receives the externally-threaded set screw 14. In other embodiments, the set screw hole 126 may be a variety of configurations that capture the set screw 14. Therefore, the set screw hole 126 may take a variety of configurations and implementations.

In some embodiments, the pulley 12 comprises two pin grooves 120. The pin grooves 120 may be channels recessed in a surface or surfaces of the pulley 12 and comprise circular patterns with rounded ends 1202, as shown. The width 1204 and depth of the pin grooves 120 may be configured to receive the stop pins 15. The radii of the rounded ends 1202 of the pin grooves 120 may be configured to allow for congruent fitting of the stop pins 15 in the rounded ends 1202. For example, the rounded ends 1202 may have radii that are slightly larger than the radii of the stop pins 15. In other embodiments, the rounded ends 1202 may not be rounded at all, but rather square, and the stop pins may take a similarly square or otherwise non-rounded, complementary shape. The grooves 120 may subtend an angle 1206 that is commensurate with the allowable limit of rotation of the pulley 12 and therefore of the motor 5. In some embodiments, the grooves 120 subtend an angle 1206 of one hundred and twenty (120) degrees. In other embodiments, the angle 1206 may be more or less than one hundred and twenty (120) degrees. In some embodiments, the grooves 120 are symmetric about the center of the pulley 12 such that rotation of the pulley is limited in equal amounts in both rotation directions 1010, 1020. For instance, an angle of one hundred and twenty (120) degrees may limit rotation of the pulley 12 to approximately sixty (60) degrees in either rotation direction 1010, 1020.

Figure 10A:
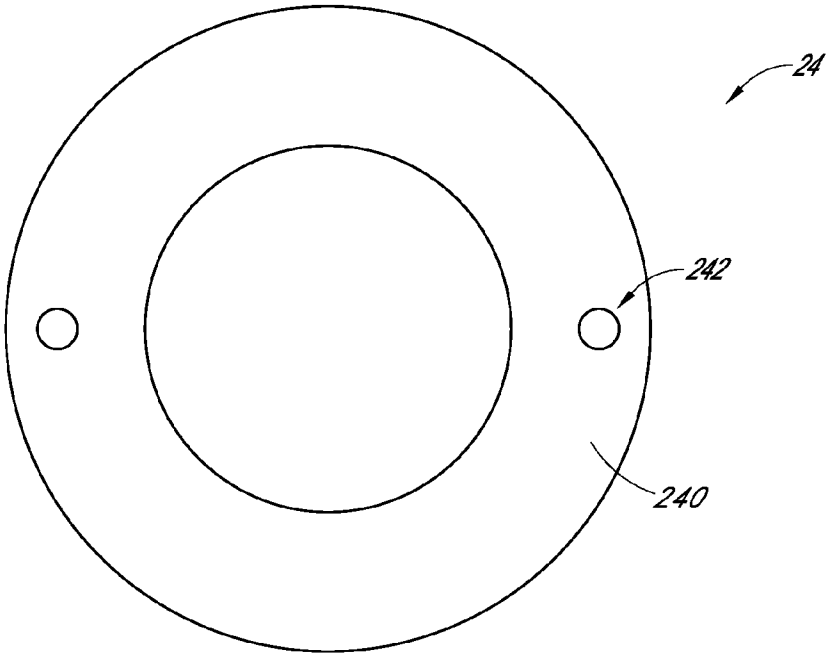
FIGS. 10A-10B are views of a lower thrust bearing from FIG. 7.
Figure 10B:
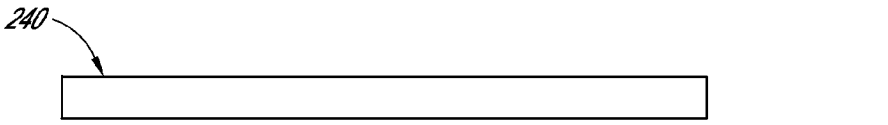

FIGS. 10A-10B are views of a lower thrust bearing 24. In some embodiments, the lower thrust bearing 24 is circular with a hole through the center. It may comprise a pulley bearing surface 240 that bears against the pulley 12. In some embodiments, the lower thrust bearing 24 further comprises stop pin holes 242 that are circular thru-holes and that receive the stop pins 15. The holes 242 are captured by the pins 15 such that the bearing 24 is prevented from rotating. Further, the pins 15 are allowed to protrude through the bearing 24 and into the pin grooves 120 of the pulley 12. In some embodiments, the inner thru-hole receives the drop-shaft 16 and is therefore circular. In some embodiments, the outer surface of the bearing 24 may be circular or other shapes, such as square. The bearing 24 may further be a variety of materials, such as composite, rubber, metal, ceramic, plastic, etc.

Figure 11:
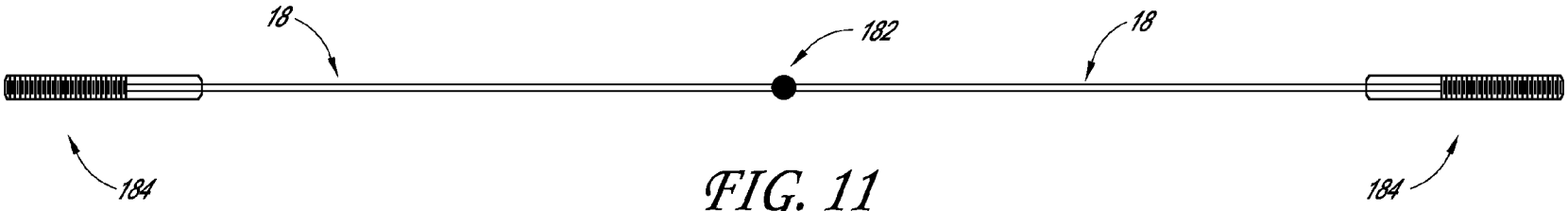
FIG. 11 illustrates an embodiment of a control pulley cable from FIG. 5.

FIG. 11 illustrates an embodiment of the control pulley cable 18. In some embodiments, the ends of the cable 18 comprise the threaded studs 184. The studs 184 couple to the stabilizer pins 32, 33. As shown, portions of the studs 184 are externally-threaded. The studs may rotationally attach to internal threads in the stabilizer pins 32, 33. In other embodiments, the studs 184 may be implemented in a variety of configurations, for example they may be snap-on fit, fully threaded, comprising recesses or other features to assist with securing to pins 32, 33, etc.

Figure 12A:
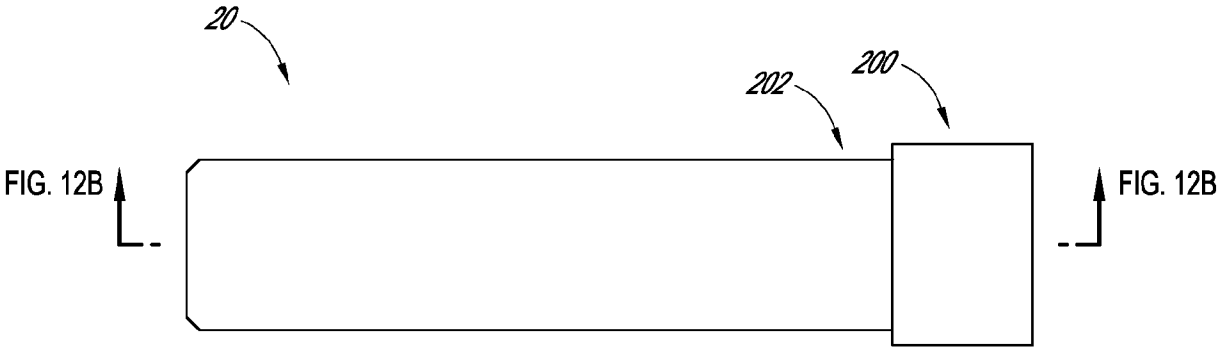
FIGS. 12A and 12B are views of a spring tube from FIG. 5.
Figure 12B:
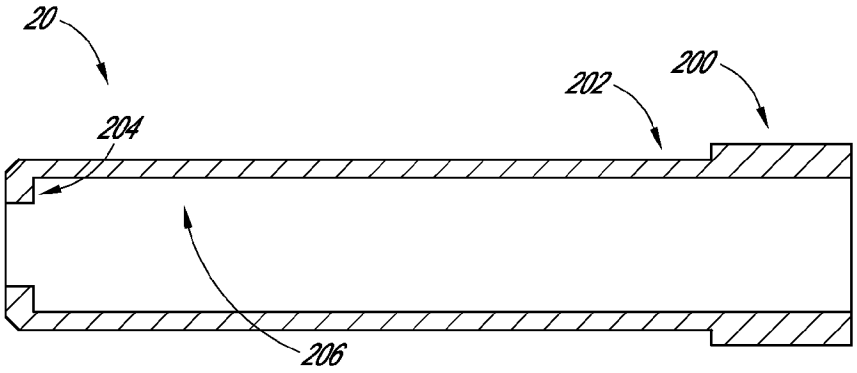

FIGS. 12A and 12B are views of the spring tube 20. The following description applies, mutatis mutandis, to spring tube 21. FIG. 12A is a side view of the spring tube 20 from which a section view is taken as depicted in FIG. 12B. As shown, the tube 20 comprises a larger outer diameter section 200, an outer alignment surface 202, a spring bearing surface 204, and an inner alignment surface 206. The center of the tube 20 comprises a bored hole that terminates to create the surface 204 against which a stabilizer spring bears. The surfaces 202 and 200 align portions of the tube 20 in the motor control subsystem 10. The surface 206 aligns components on the interior of the tube 20 when configured in a motor control subsystem 10. The spring tube 20 further protects and houses various components of the system 10, as discussed above. In some embodiments, the tube 20 is metal, such as stainless steel, although it may be a variety of materials such as composite, ceramic, plastic, etc.

Figure 13B:
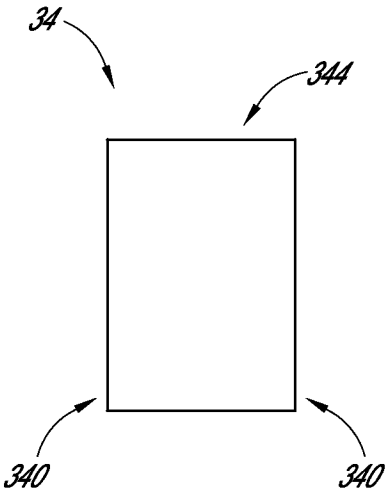
FIGS. 13A and 13B are views of a stabilizer bushing from FIG. 6A.
Figure 13A:
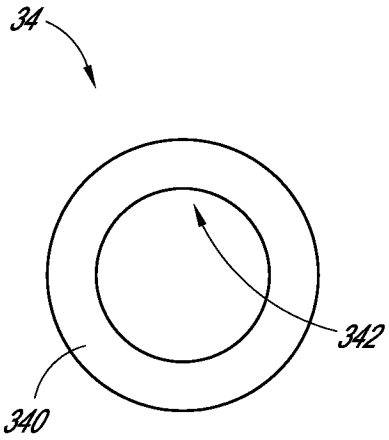

FIGS. 13A and 13B are views of the stabilizer bushing 34. The following description applies, mutatis mutandis, to stabilizer bushing 35. In some embodiments, the bushing 34 comprises a cylindrical member with a thru-hole down the center. The bushing 34 may comprise bearing surfaces 340, an inner alignment surface 342, and an outer alignment surface 344. The bearing surfaces 340 provide the surfaces against which, for example, the stabilizer pin 32 and the stabilizer spring 36 may bear. The surface 344 may align the bushing inside of, for example, the spring tube 20. The surface 342 may align internal components when configured in a motor control subsystem 10, for example the stabilizer pin 32 and the pulley cable 18. The bushing 34 in some embodiments is a metallic material such as stainless steel, although in other embodiments it may be implemented in other materials, including composite, ceramic, plastic, etc.

Figure 14A:
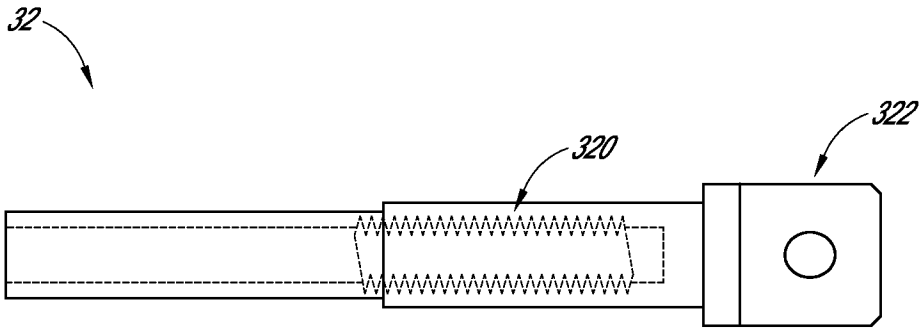
FIGS. 14A and 14B are views of a stabilizer pin from FIG. 6A.
Figure 14B:
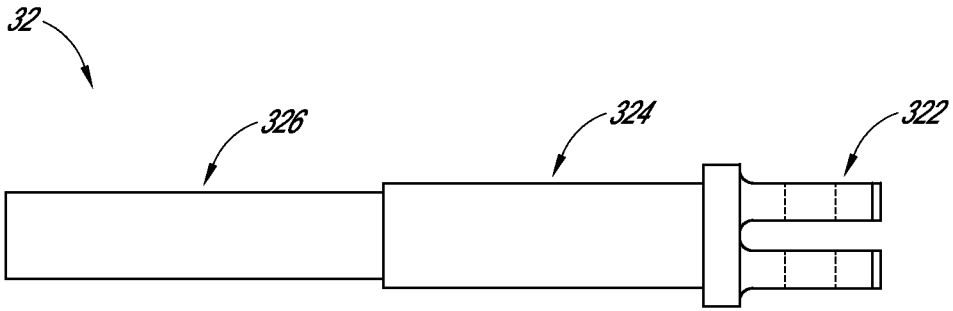

FIGS. 14A and 14B are views of the stabilizer pin 32. The following description applies, mutatis mutandis, to stabilizer pin 33. The pin 32 includes a double lug 322 on one end that may couple with the rudder cord 26. The double lug 322 includes a hole through which a quick release pin may be inserted to couple the pin 32 to the pin coupling 260. On the other end of the pin 32, the small diameter section 326 defines a hollow cylindrical cavity through which the pulley cable 18 and the threaded end 184 may extend. Between these two ends of the pin 32 is the larger diameter section 324 further defining a cylindrical hollow cavity. Internal to the larger diameter section 324 is an internally-threaded section 320, which may also extend to the internal cavity defined by the smaller diameter section 326, and with which the threaded end 184 of the pulley cable 18 may couple. The larger diameter section 326, when configured in a motor control subsystem 10, further guides and aligns the pin 32 while positioned inside of, and as it translates through, the spring tube 20. The section 326 also provides an end against which the stabilizer bushing 34 may bear or contact when in operation. The smaller diameter section 326, when configured in the motor control subsystem 10, further guides and aligns the stabilizer spring 36. When the pin 32 is translating, the double lug 322 comprises a wide diameter flange that acts as a stop to prevent the pin 32 from entering the frame assembly 90. In some embodiments, the pin 32 is substantially cylindrical or of circular cross-section, however it may be implemented in a variety of shapes and configurations to integrate with the motor control subsystem. For instance, the pin 32 may comprise square cross-sections. Further, the lengths of the sections 326 and 324 as shown are for illustration, and various proportions of length may be implemented.

Figure 15:
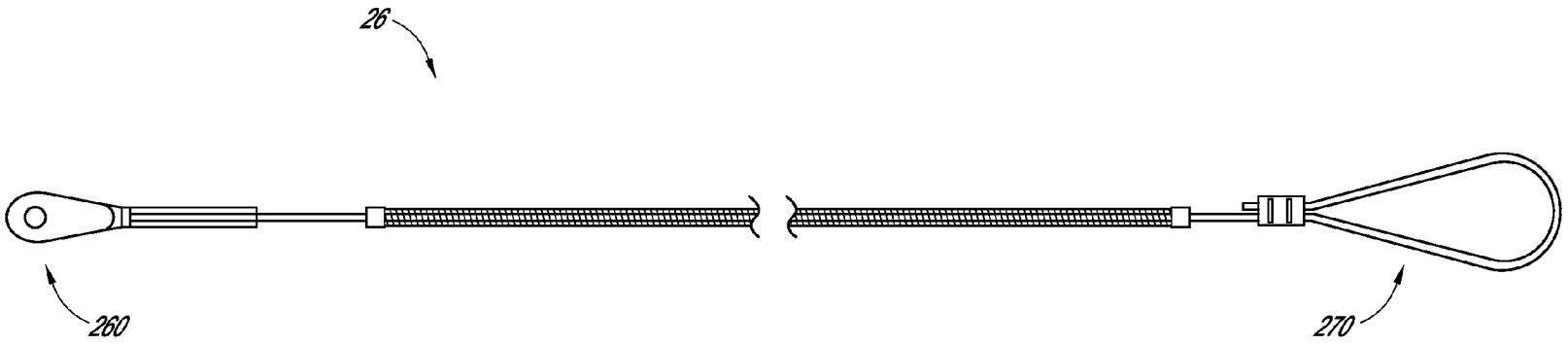
FIG. 15 illustrates an embodiment of a rudder cord from FIG. 1.

FIG. 15 illustrates an embodiment of the rudder cord 26. The following description applies, mutatis mutandis, to the rudder cord 25. The rudder cord 26 provides a linkage between the stabilizer pin 32 and the cord 27. On one end, the pin coupling 260 comprises a substantially planar member with a through hole that provides for coupling with the double lug 322 of the stabilizer pin 32. On the other end is a rudder cord coupling 270 that comprises a loop for coupling to the cord 27. In some embodiments, the coupling 270 is adjustable such that the cord 26 may be lengthened or shortened and/or the loop may be enlarged or reduced. Between the two ends of the cord 26 may be a protective sheath as shown, which may extend the length of the cord 26. In some embodiments, the rudder cord 26 is made of synthetic fiber. In other embodiments, the cord 26 is natural fiber, composite, metallic, or a variety of other suitable materials. Further, a variety of end couplings may be implemented that are within the scope of the present disclosure.

Figure 16A:
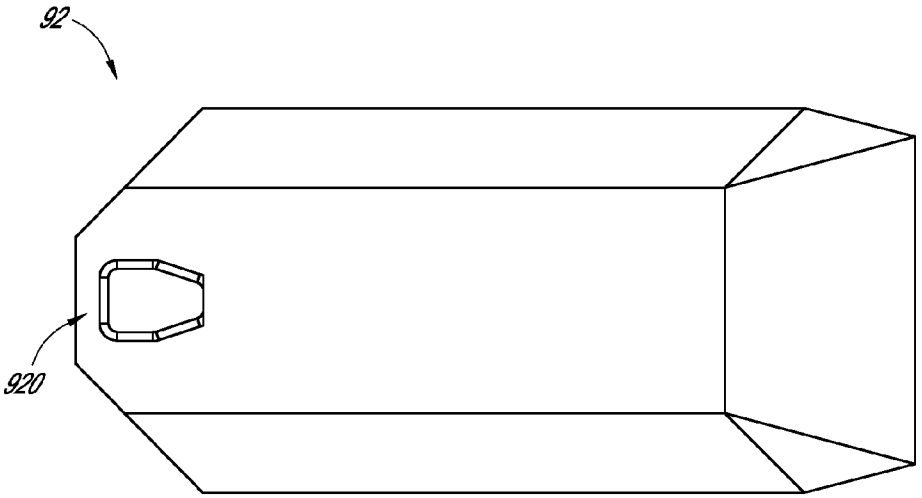
FIGS. 16A-16C are views of an upper frame from FIG. 4.
Figure 16B:
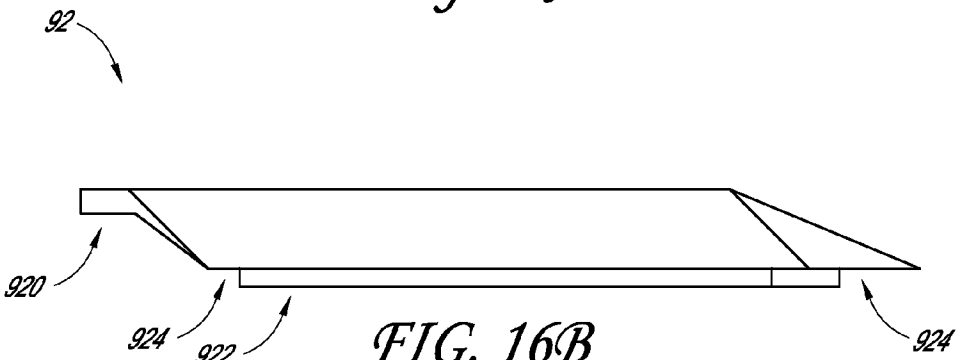
Figure 16C:
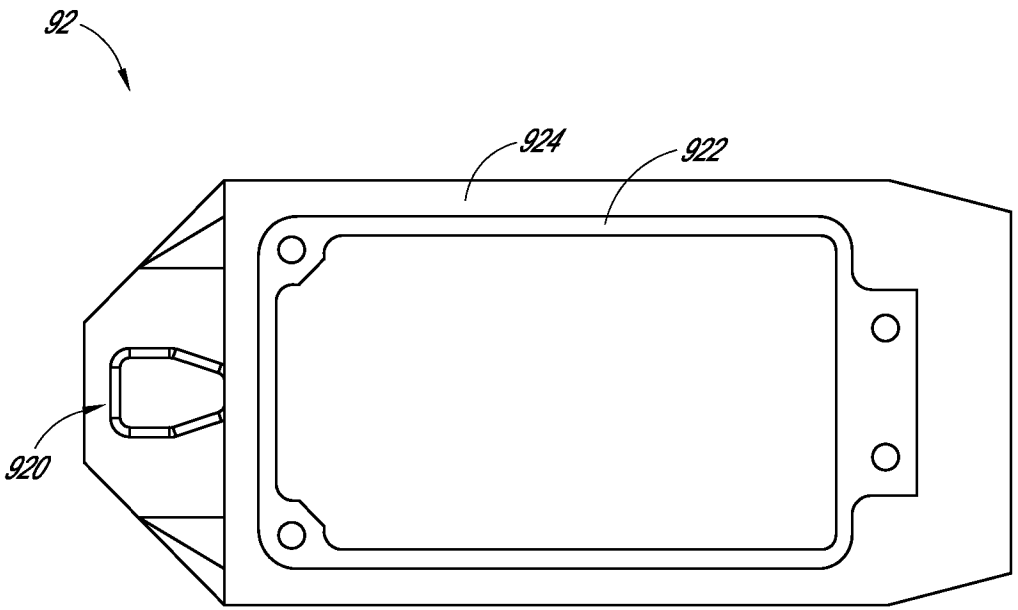

FIGS. 16A-16C are views of the upper frame 92. The upper frame 92 provides an upper closure to the frame assembly 90. FIG. 16A depicts a top view of the upper frame 92. On an end of the upper frame 92 is the tow loop 920, best shown in FIG. 16A, comprising an opening in an overhang section of the upper frame 92. The tow loop 920 provides for coupling a tow line or other component by which the kayak 3 may tow or be towed. FIG. 16B depicts a side view of the upper frame 92. As shown, a lower surface 922 protrudes slightly below a lower surface 924 to provide for alignment of the upper frame 92 when configured in the frame assembly 90. FIG. 16C is a bottom view of the upper frame 92, depicting tow loop 920 as well as the surfaces 922 and 924. Multiple bores are depicted as well which provide threaded holes by which the upper frame 92 may be coupled to the frame assembly 90. The upper frame 92 in some embodiments is a metal such as stainless steel or aluminum, but in other embodiments it may be a number of materials such as composite, polymer, plastic, etc.

Figure 17A:
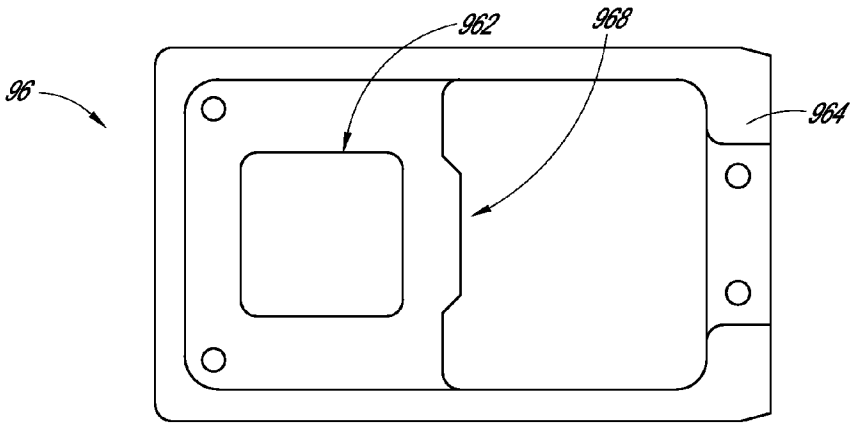
FIGS. 17A-17D are views of a frame from FIG. 4.

FIGS. 17A-17D are various views of the frame 96. The frame 96 couples to the bottom of the upper frame 92 and provides a middle section to the housing formed by the frame assembly 90. FIG. 17A illustrates a top view of an embodiment of the frame 96 depicting a shelf 968 with a bearing cutout 962. The shelf 968 extends into the interior of the frame 96 and provides, among other things, an upper surface against which an upper thrust bearing 22 bears. The shelf 968 provides a structural support and barrier for the bearing 22 and other parts, for instance the pulley 12, and further secures the bearing 22 in place. As shown, the cutout 962 is substantially square-shaped, which can therefore receive an embodiment of the bearing 22 which has a substantially square-shaped upper portion. The shelf 968 further comprises an extended lip or edge which allows for supporting, and acting as a barrier for, a larger diameter bearing 22 and/or pulley 12. FIG. 17A also depicts surface 964 which contacts and aligns the upper frame 92 when configured in a frame assembly 90.

Figure 17B:
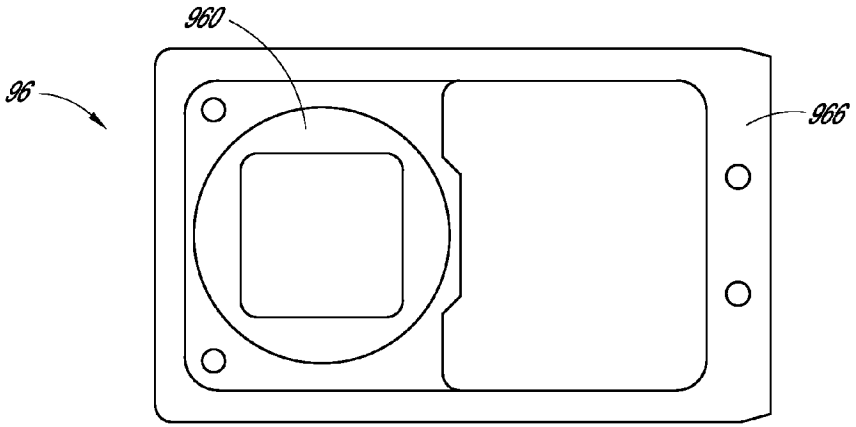

FIG. 17B depicts a bottom view of the frame 96. On the lower side of shelf 968, as depicted in the embodiment of the frame 96 shown, is a substantially circular recess. This recess may be ⅛" deep and receive a flange on the upper thrust bearing 22. Other dimensions and shapes of the recess may be implemented. Further depicted is surface 966 that contacts and aligns the lower frame 94 when configured in the frame assembly 90. Through holes in the frame 96, as shown in FIGS. 17A and 17B, allow for coupling of the frame 96 to the upper frame 92 and the lower frame 94. In some embodiments, circular bolts extend through these holes and couple on either side of the frame 94 to other parts.

Figure 17C:
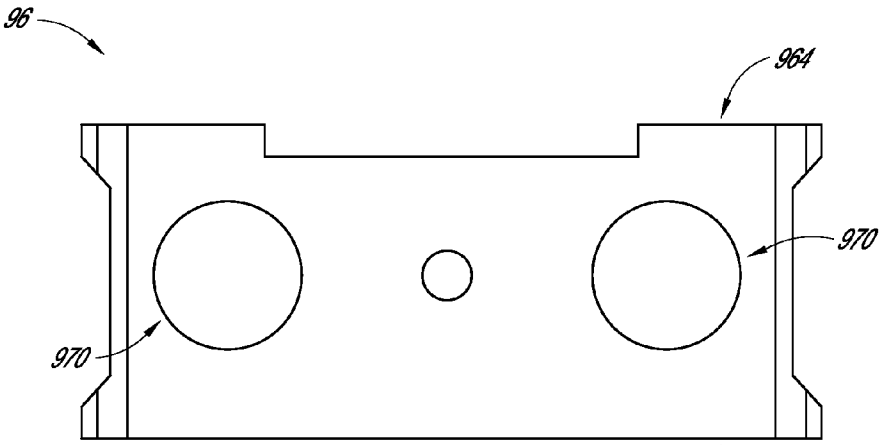
Figure 17D:
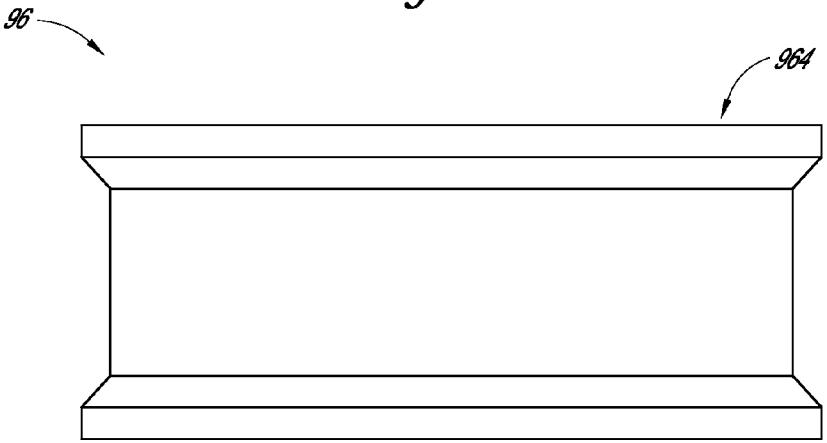

FIG. 17C depicts a front view of the frame 96. As shown, two through holes 970 are in this front face. These holes 970 receive the spring tubes 20, 21 when configured in the motor control subsystem 10. In that configuration, this front face also contacts the flanges of the tubes 20, 21 as well as the back face of the frame extension 98. Further depicted are the top surface 964 and the bottom surface 966. FIG. 17D is a back view of the frame 96. As shown in both FIGS. 17C and 17D, the profiles of the sides of the frame 96 in some embodiments are recessed. In other embodiments, the sides may be flat or comprise a variety of other profiles. In some embodiments, the frame 96 is metallic, such as stainless steel or aluminum. In other embodiments, it may be fiberglass or other composite, polymer, plastic, or a variety of other suitable materials.

Figure 18B:
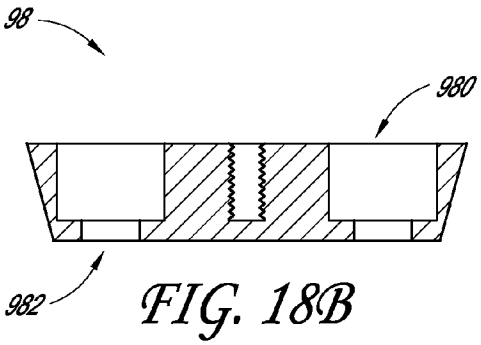
FIGS. 18A-18C are views of a frame extension from FIG. 4.
Figure 18A:
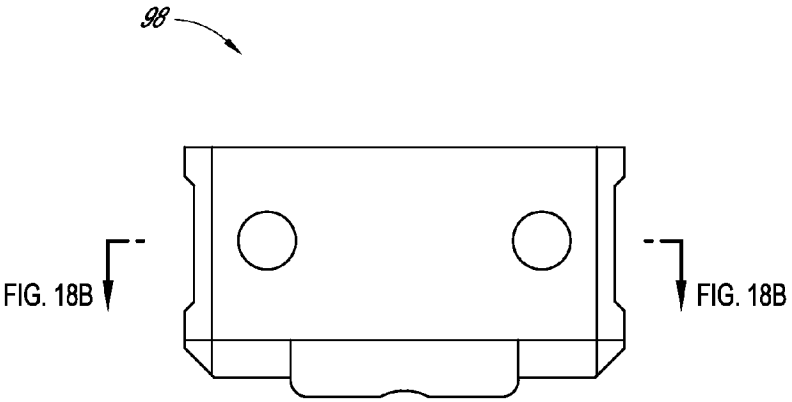
Figure 18C:
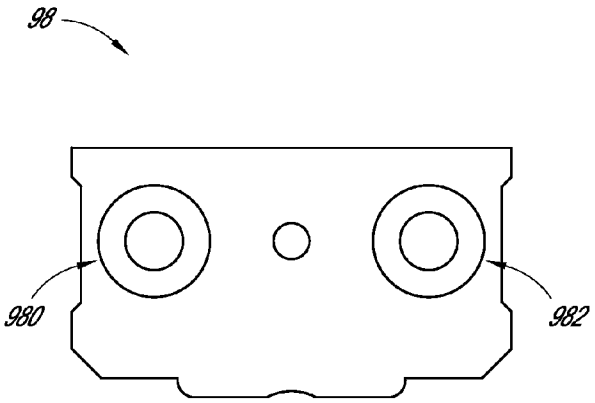

FIGS. 18A-18C are various views of the frame extension 98. The frame extension 98 couples to the front end of the frame assembly 90. In some embodiments, the frame extension 98 is metallic, such as stainless steel or aluminum. In other embodiments, it may be fiberglass or other composite, polymer, plastic, or a variety of other suitable materials. FIG. 18A is a front view of the frame extension 98, comprising through holes 982. In some embodiments, the holes 982 receive stabilizer pins 32, 33. These holes may be substantially circular, as shown, or they may be square or other cross-sectional shapes. Further detail of holes 982 is shown in the section view FIG. 18B, which is taken from FIG. 18A as shown. The through holes 982 open up to larger diameter holes or bores 980. Holes 980 receive the larger outer diameter sections 200 of spring tubes 20, 21. In other embodiments, the sections 200 and holes 980 are threaded and may rotatably couple. Further shown in FIG. 18B is a threaded hole between holes 980 that in some embodiments allows for coupling the frame extension 98 to the frame 96 with, for example, a threaded fastener. In other embodiments, other types of fasteners and corresponding hole features may be implemented. FIG. 18C shows a rear view of the frame extension 98, further depicting holes 980 and 982.

Figure 19A:
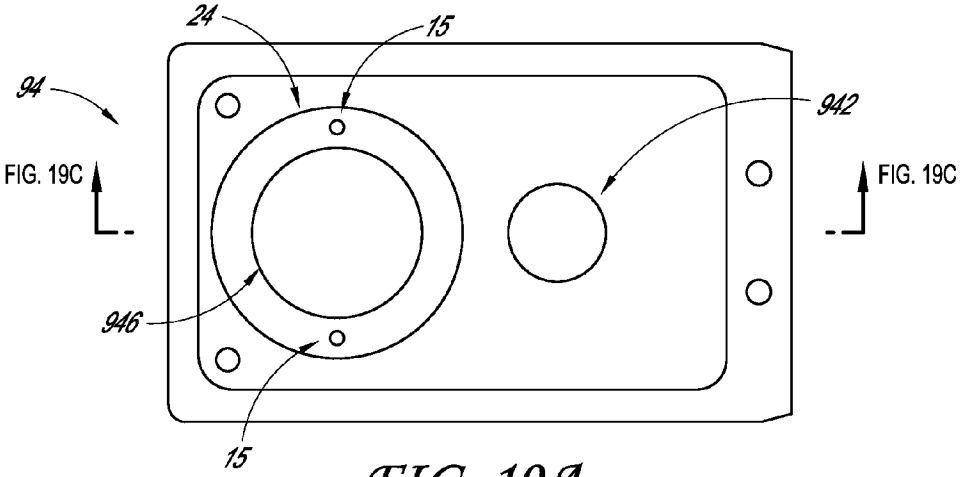
FIGS. 19A-19E are views of a lower frame from FIG. 4.

FIGS. 19A-19E are various views of the lower frame 94. In some embodiments, the lower frame 94 is metallic, such as stainless steel or aluminum. In other embodiments, it may be fiberglass or other composite, polymer, plastic, or a variety of other suitable materials. The lower frame 94 provides, among other things, a lower closure to the frame assembly 90. The lower frame 94 also provides pin stops 15 that prevent over-rotation of the motor 5. FIG. 19A is a top view of the lower frame 94 configured with the lower thrust bearing 24 around a shaft hole 946. As shown, the hole 946 is substantially circular. The pin stops 15 are diametrically positioned on either side of the hole 946. Further, the bearing 24 comprises holes through which the pin stops 15 protrude. The pulley 12 contacts this surface of the bearing 24 and receives the pin stops 15 in the pulley's pin grooves 120. In some embodiments, the pin stops 15 are cylindrical stubs that provide a stop to prevent the pulley 12 from rotating past a certain angular displacement. The pin stops 15 may be short, solid pins to minimize imparted moment and thereby reduce stress when the maximum rotation of the pulley 12 is reached. The motor 5 may be rotated to its maximum positions a large number of times over the life of the system 10, therefore cyclic fatigue and structural integrity of the pin stops 15 are critical. In some embodiments, the stops 15 are integral with the lower frame 94. In other embodiments, the stops 15 are assembled to the lower frame 94 and may be replaced from time to time. FIG. 19A further depicts wire hole 942. The wire harness 71 may extend into and through the wire hole 942. The hole 942 leads to a substantially right-angle channel, such that the wire harness 71 may exit the lower frame 94 at a right angle to the axis of hole 942.

Figure 19B:
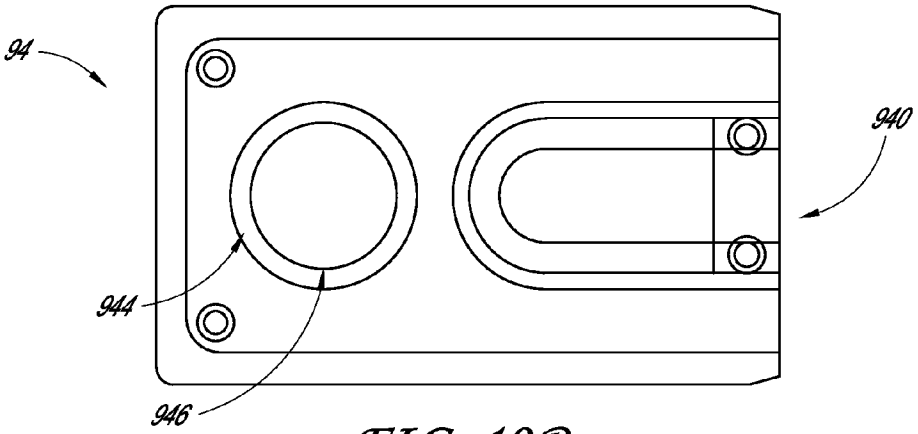

FIG. 19B is a bottom view of the lower frame 94. The shaft hole 946 is depicted and is defined by a bushing cylinder 944. The cylinder 944 receives the drop-shaft bushing 17. On the other end of the lower frame 94 is the threaded end 940 which connects to the wire hole 942 shown in FIG. 19A. The threaded end 940 further receives the wire tunnel 56. Both FIGS. 19A and 19B depict four though holes which may receive fasteners to secure the frame assembly 90.

Figure 19C:
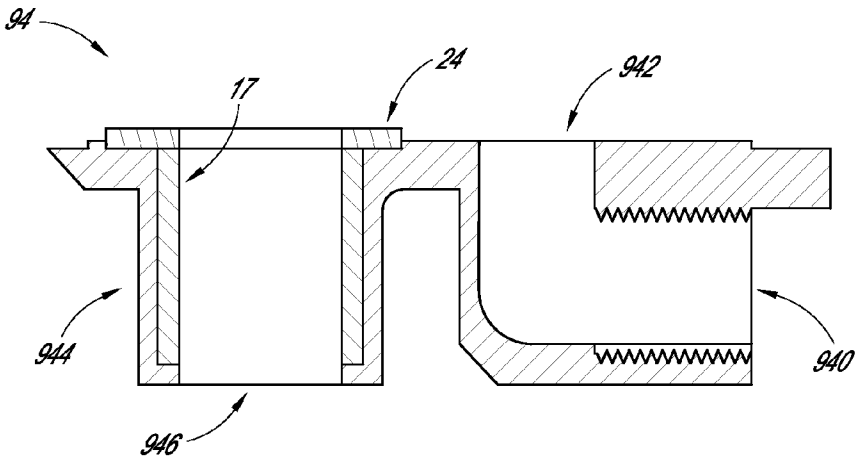

FIG. 19C depicts a section view of the lower frame 94 from a section taken as depicted from FIG. 19A. The threaded end 940 that receives the wire tunnel 56 is shown exiting the right side of the lower frame 94 as shown and turning at a right angle to connect to the wire hole 942 on the top of the lower frame 94. Further, FIG. 19C depicts the shaft hole 946 which comprises a flange on which the drop-shaft bushing 17 sits. The bearing 24 is also shown sitting in the recess on top of the lower frame 94.

Figure 19D:
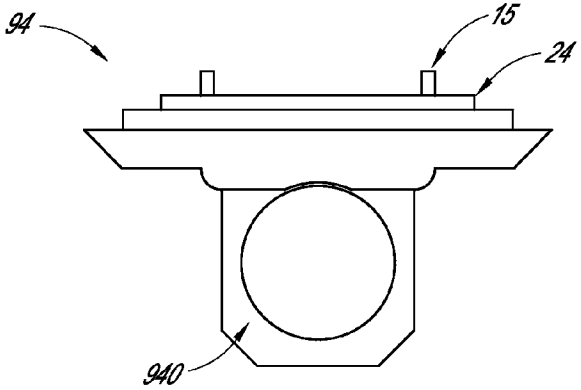
Figure 19E:
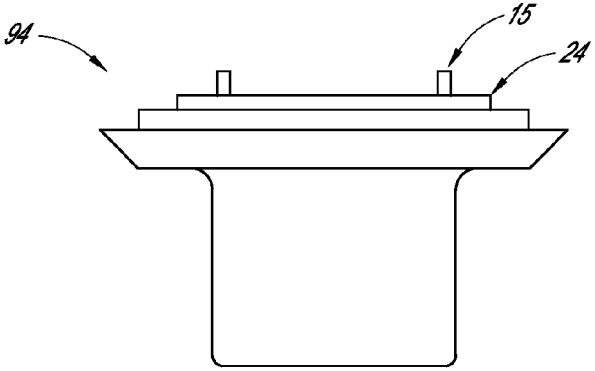

FIGS. 19D and 19E depict front and back views, respectively, of the lower frame 94. The threaded end 940 is shown as a circular opening on the front side. Both views show the pin stops 15 protruding through bearing 24.

Figure 20A:
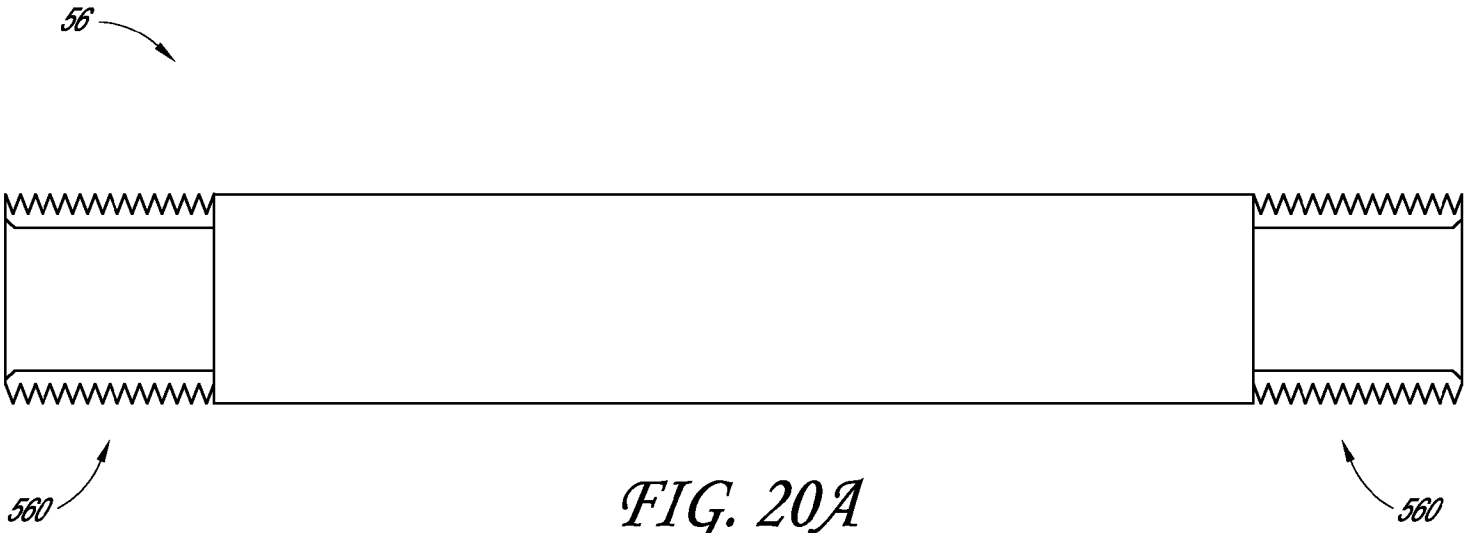
FIGS. 20A and 20B are views of a wire tunnel from FIG. 3.
Figure 20B:
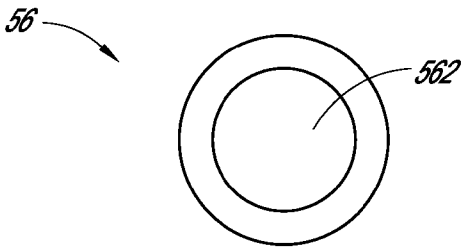

FIGS. 20A and 20B are views of the wire tunnel 56. The tunnel 56 provides, among other things, a housing through which the wire harness 71 may extend. It also provides a handle by which the mount and control system 1 may be carried or otherwise transported. In some embodiments, the tunnel 56 is made of a metallic material. In other embodiments, it may be composite, ceramic, fiberglass, polymer, plastic, or other suitable materials. The wire tunnel 56 may have ends 560 that are threaded. The threaded ends may rotatably couple to the lower frame 94 on one end and a mounting elbow 52 on the other. The tunnel 56 in some embodiments is a cylindrical member defining a wire hole 562 internally through which the wire harness 71 may extend or otherwise be housed. The length of the tunnel 56 may be varied according to the rearward extension or overhang desired for the motor 5 and other rearward components of the system 1. The tunnel 56 thus provides an adjustable extension to accommodate, for example, different rear shapes and other rear features of the kayak 3.

Figure 21B:
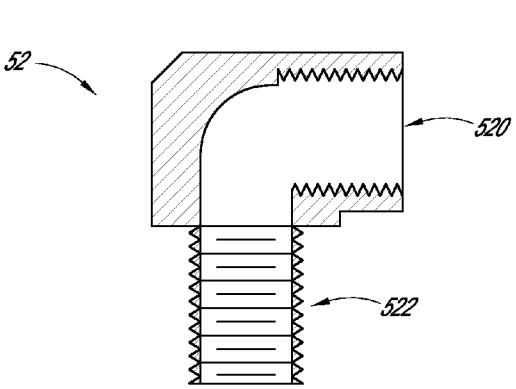
FIGS. 21A-21D are views of a mounting elbow from FIG. 3.
Figure 21D:
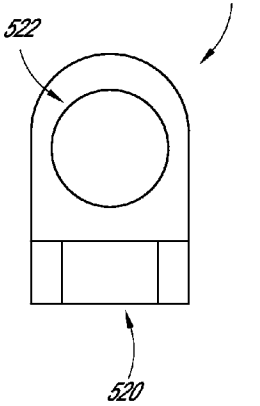
Figure 21A:
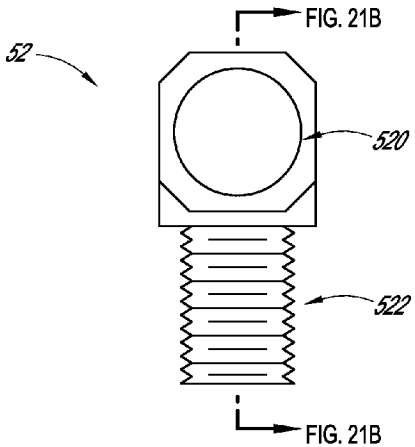
Figure 21C:
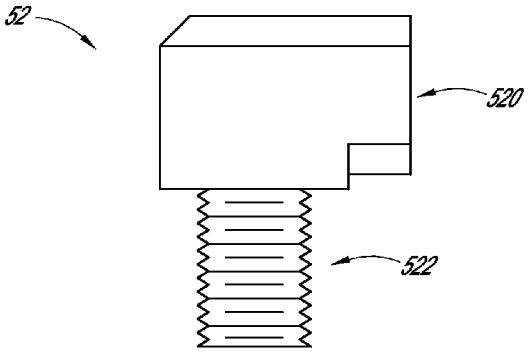

FIGS. 21A-21D are views of the mounting elbow 52. FIG. 21A shows a rear view of the elbow 52 comprising internal portion 520 and external portion 522. In some embodiments, the portion 522 is externally threaded and rotatably couples to, among other things, internally threaded parts such as a nut 54. Portion 520 may be internally-threaded to rotatably couple to the externally-threaded ends of the wire tunnel 56. In other embodiments, the portions 520 and/or 522 may have a variety of features other than threads for coupling to other parts. The section taken in FIG. 21A is depicted as the section view shown in FIG. 21 B. As shown, the portion 522 may define an internal cavity or hole that connects to another internal cavity or hole at a right angle, the other cavity being defined by portion 520. These cavities provide a housing or passageway through which the wire harness 71 may enter and/or extend. In some embodiments, the wire harness 71 enters/exits the elbow 52 at the portion 522 from/to the dry storage 7 of the kayak 3, and it exits/enters the elbow 52 at the portion 520 to/from the wire tunnel 56. FIGS. 21C and 21D further depict the elbow 52, respectively, from the side and rear.

Figure 22C:
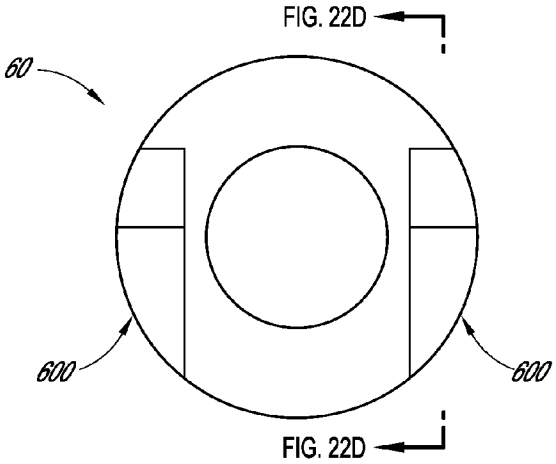
FIGS. 22A-22D are views of an upper plate from FIG. 3.
Figure 22B:
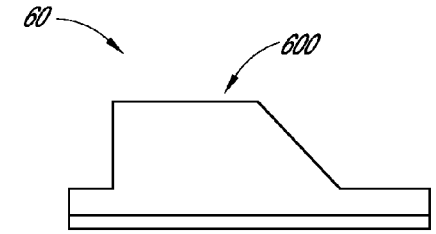
Figure 22D:
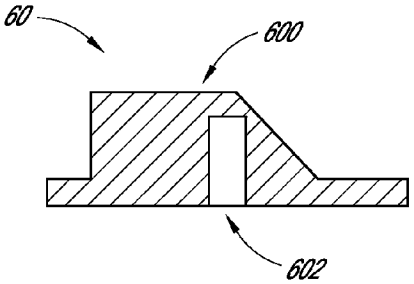
Figure 22A:
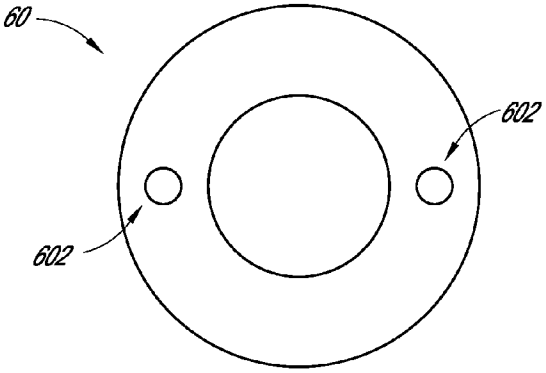

FIGS. 22A-22D are views of the upper plate 60. In some embodiments, the upper plate 60 is configured between the elbow 52 and the outside or upper side of the kayak 3, as mentioned. FIG. 22A depicts a bottom view of the upper plate 60 comprising a lower surface that contacts the kayak 3 in some embodiments. In other embodiments, the surface shown sits on the spacer 601, see FIG. 22B, or another washer-like part that separates the upper plate 60 from the kayak 3. As mentioned, this may provide height to the rearward components of the mount and control system 1. This surface shown may be prepared, chemically or mechanically or otherwise, to mitigate unfavorable chemical, mechanical, or other interaction with the kayak 3 or spacer 601. Holes 602 allow for coupling the upper plate 60 to, among other things, the lower plate 62. This coupling may be advantageous, for instance, when the rearward portions of the system 1 are detached from the kayak 3 by securing the parts together. FIG. 22B shows a side view of an embodiment of the upper plate 60 comprising the spacer 601 on the lower surface. The spacer 601 in some embodiments has a similar shape as the lower surface of the plate 60, for example circular. In other embodiments, the spacer may be a different shape, for example square. An ear 600 is also shown in FIG. 22B. The ears 600 provide barriers or stops that prevent and/or reduce rotation of the elbow 52 when configured in the system 1. The ears 600 in some embodiments are tapered projections on either side of the plate 60 with flat interior surfaces to capture flat exterior surfaces of the elbow 52. The interior faces of the ears are better shown in FIG. 22C, which depicts a top view of the upper plate 60. The ears 600 are shown on either side of the center hole of the plate 60 with flat interior surfaces and rounded exterior surfaces. The section taken in FIG. 22C is depicted in the section view shown in FIG. 22D. As shown, holes 602 may extend into the plate 60 and/or into the ears 600. The holes 602 may be threaded or comprise other features to capture a fastener.

Figure 23A:
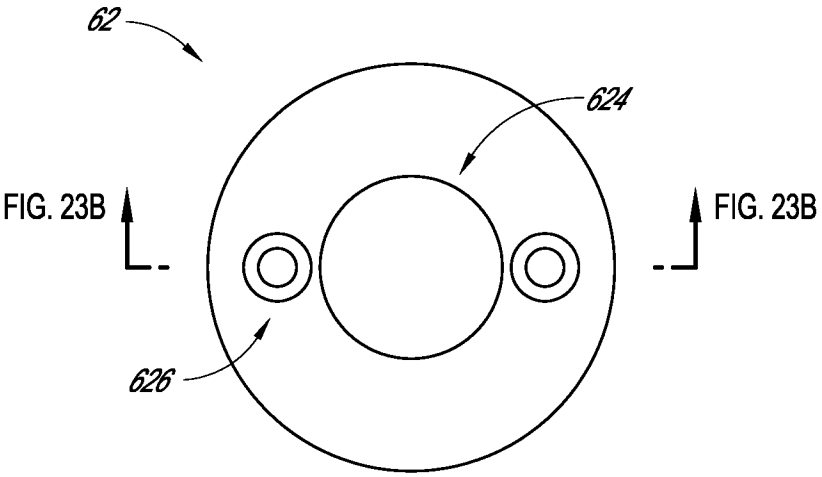
FIGS. 23A and 23B are views of a lower plate from FIG. 7.
Figure 23B:
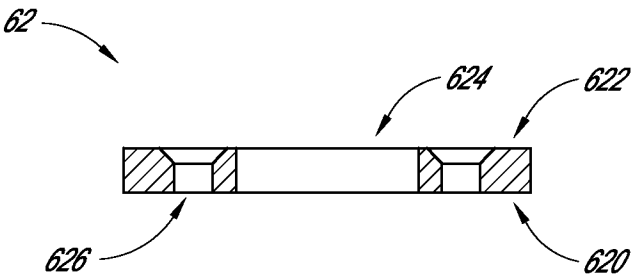

The upper plate 60 may couple to the lower plate 62, of which a bottom view is depicted in FIG. 23A. The plate hole 624 receives the portion 522 of the elbow 52. The holes 626 on either side of the center hole 624 allow for coupling the lower plate 62 to, among other things, the upper plate 60. The holes 626 may be thru holes, or they may be counter sunk with sinks that are flat and/or at an angle. Further depicted in FIG. 23A is a surface that in some embodiments contacts an interior surface of the kayak 3, as mentioned. The section taken in FIG. 23A is shown in the section view shown in FIG. 23B. As shown, the holes 626 may be countersunk through-holes with angled countersinks. Further shown is surface 620 which bears against the kayak 3 and a surface 622 which bears against a nut 54, see FIG. 4. In some embodiments, the upper plate 60 and the lower plate 62 are metallic, such as stainless steel. In other embodiments, they may be a variety of metals or other materials, such as titanium, fiberglass, polymers, or other suitable materials.

Figure 24B:
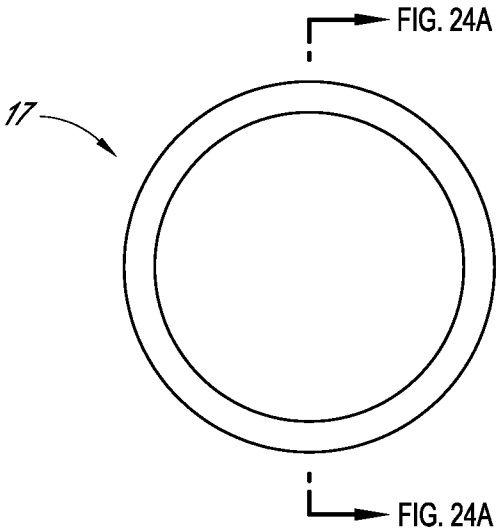
FIGS. 24A and 24B are views of a lower drop-shaft bushing from FIG. 3.
Figure 24A:
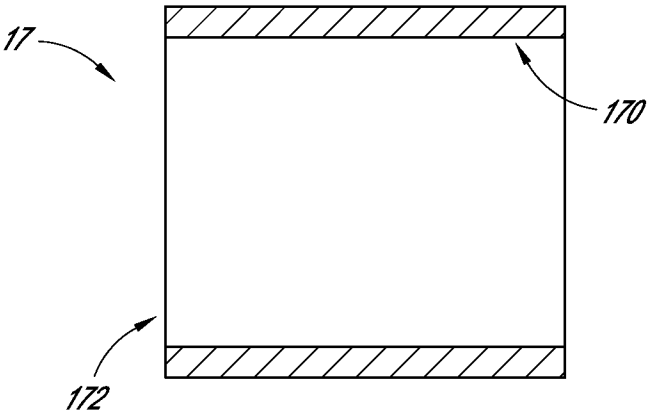

FIGS. 24A and 24B are views of the lower drop-shaft bushing 17. FIG. 24A is a section view of the section taken from a top view of the bushing as shown in FIG. 24B. As mentioned, the bushing 17 decreases rotational friction between the drop-shaft 16 and the lower frame 94. In some embodiments, it is a different material from the lower frame 94 to assist with decreasing friction and/or cold welding. It may be composite, metal, etc. In other embodiments, it is the same material as the lower frame 94 and may be surface treated, for example anodized or otherwise electrochemically processed. The bushing 17 comprises a hollow cylindrical wall defining a bushing hole 172 and an interior shaft bearing surface 170. The drop-shaft 16 may bear against the inner surface 170. On the external side of the wall, the drop-shaft 16 may bear against the inner surfaces of the bushing cylinder 944 on the lower frame 94.

Figure 25:
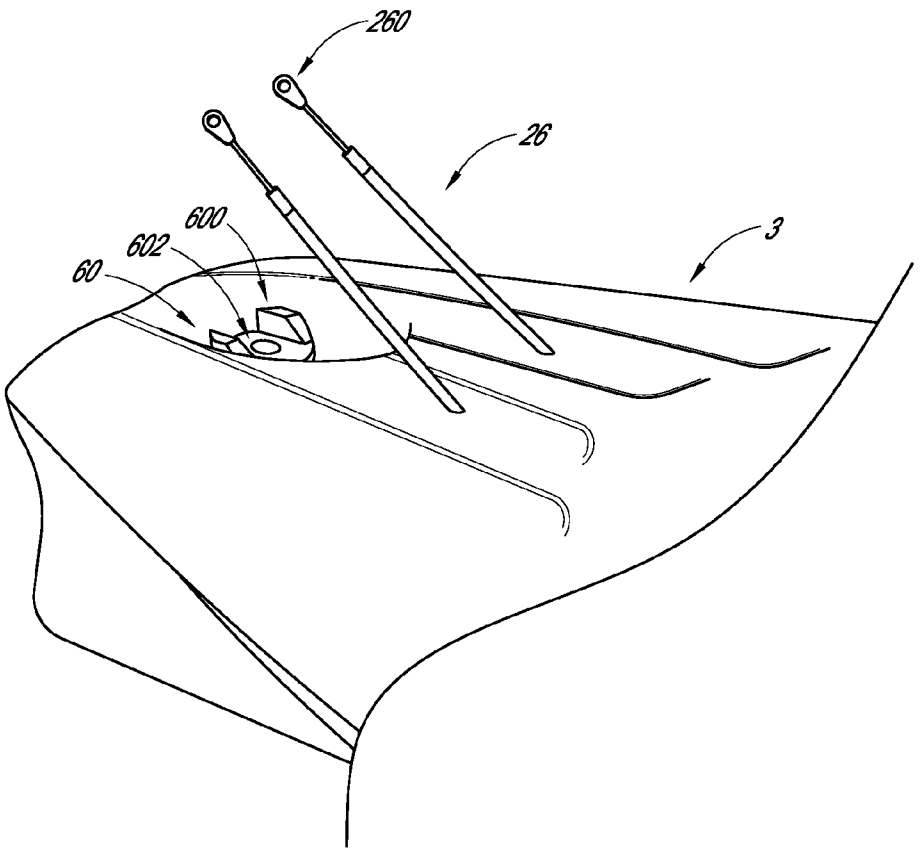
FIG. 25 is a perspective view of the stern of the kayak from FIG. 1 with the mount and control system removed.

FIG. 25 is a perspective view of the kayak 3 with the motor 5 and other rearward components of the mount and control system 1 removed. Two of the interfaces mentioned above are visible. The first interface is the upper plate 60, depicted with hole 602 and ears 600. When the system 1 is mounted on the kayak 3, the hole 602 receives the wire harness 71 and the lower portion 522 of the elbow 52. In some embodiments, the wire harness 71 may extend through a different opening in the kayak 3, for example a hole with locknuts that is adjacent to the elbow 52. The second interface shown is the pin couplings 260 on the ends of the rudder cords 26, 25. When the system 1 is mounted on the kayak 3, the couplings 260 couple to stabilizer pins 32, 33. The third interface is inside the portion of the kayak shown but is not visible in the figure. In some embodiments, all of the mounting parts except for the elbow 52 are removed when the motor 5 and other rearward components of the mount and control system 1 are removed.

Figure 26:
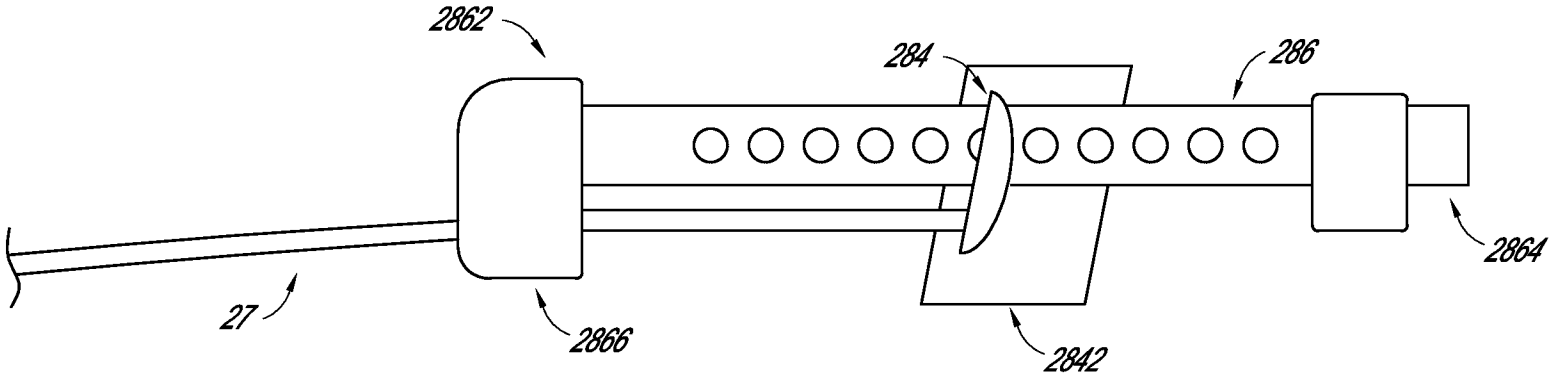
FIG. 26 is a side view of a foot peg and rail.

FIG. 26 is a side view of the foot peg 284 and the rail 286. In some embodiments, the rail 286 is coupled to the side wall of the kayak 3 inside the cockpit 9. The rail may be coupled with a rail support 2862. A bottom portion 2866 of the rail support 2862 may guide the cord 27. In other embodiments, the bottom portion 2866 has a through-passage to allow the cord 27 to freely pass. The cord 27 couples to the foot peg 284. In some embodiments, the cord 27 couples to the lower portion of the foot peg 284. The foot peg 284 may be rotatably coupled to the rail 286. The lower portion of foot peg 284 may be pressed and the foot peg 284 will rotate. In other embodiments, the foot peg 284 may be pressed and the foot peg 284 will translate in the forward direction. In other embodiments, the foot peg 284 will rotate and translate. A foot peg support 2842 may support the foot peg 284 and/or couple to the cord 27. A forward portion 2864 of the rail 286 may couple the rail 286 to the side wall of the kayak 3 inside the cockpit 9. In some embodiments, the forward portion of the rail 286 is an elastic element such as a spring that spring-loads and biases the foot peg 284 in the forward direction. The portion of the rail 286 that is rearward of the foot peg 284 may be rigid to provide resistance to the foot peg 284 in the rearward direction. Still other configurations and implementations of the spring-loaded foot peg 284 may be used and are within the scope of the present disclosure.

Although this invention has been disclosed in the context of certain preferred embodiments and examples, it will be understood by those skilled in the art that the present invention extends beyond the specifically disclosed embodiments to other alternative embodiments and/or uses of the invention and apparent modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A motor steering apparatus for steering a watercraft motor, the apparatus comprising:

a stabilizing member having a starting position and configured to couple with a peg linkage;

a rotational member having a starting rotational position and coupled with the stabilizing member, the rotational member configured to couple with a motor so that displacement of the stabilizing member in a first direction rotates the rotational member in a first rotation direction, wherein rotation of the rotational member in the first rotation direction rotates the motor in a first motor rotation direction;

a stabilizing spring coupled with the rotational member;

a second stabilizing member coupled with the rotational member, the second stabilizing member having a second starting position and configured to couple with a second peg linkage, wherein displacement of the second stabilizing member in the first direction rotates the rotational member in a second rotation direction that is opposite the first rotation direction, and wherein rotation of the rotational member in the second rotation direction rotates the motor in a second motor rotation direction that is opposite the first motor rotation direction;

a second stabilizing spring coupled with the rotational member;

a cable coupled with the rotational member and comprising a first end and a second end, wherein the first end couples with the stabilizing member and the second stabilizing spring, and the second end couples with the second stabilizing member and the stabilizing spring; and a frame that includes and supports the stabilizing member, the second stabilizing member, the rotational member, the stabilizing spring, and the second stabilizing spring, and wherein the frame is further configured to couple to a watercraft, wherein applying a first pressure to the first peg linkage causes a first change in mechanical energy stored in the first stabilizing spring, wherein, upon decreasing the first pressure applied to the peg linkage, the stabilizing spring rotates the rotational member in the second rotation direction and displaces the stabilizing member in a second direction opposite the first direction, wherein, upon removing the first pressure applied to the peg linkage, the stabilizing spring rotates the rotational member to the starting rotational position and displaces the stabilizing member to the starting position, wherein applying a second pressure to the second peg linkage causes a second change in mechanical energy stored in the second stabilizing spring, wherein, upon decreasing the second pressure applied to the second peg linkage, the second stabilizing spring rotates the rotational member in the first rotation direction and displaces the second stabilizing member in the second direction, and wherein, upon removing the second pressure applied to the second peg linkage, the second stabilizing spring rotates the rotational member to the starting rotational position and displaces the second stabilizing member to the second starting position.

2. The motor steering apparatus of claim 1, wherein the frame is configured to couple to a watercraft at a single coupling location.

3. The motor steering apparatus of claim 2 wherein the frame is configured to couple to an off-the-shelf watercraft wherein the off-the-shelf watercraft is modified with a single hole.

4. The motor steering apparatus of claim 3 wherein the watercraft is a kayak.

5. The motor steering apparatus of claim 4, further comprising a wiring harness configured for quick connection and quick disconnection of the motor outside the kayak to an electrical unit inside the kayak.

6. The motor steering apparatus of claim 5, wherein the kayak further comprises a seat in a cockpit, and the electrical unit comprises a motor throttle control.

7. The motor steering apparatus of claim 2, further comprising:

a first watercraft peg linkage;

a second watercraft peg linkage;

a first watercraft peg; and a second watercraft peg, wherein the first watercraft peg linkage links the first watercraft peg to the stabilizing member, and wherein the second watercraft peg linkage links the second watercraft peg to the second stabilizing member.

8. The motor steering apparatus of claim 7 wherein the first and second watercraft pegs are foot pegs configured to prevent slack in the linkages.

9. The motor steering apparatus of claim 1, further comprising:

at least one pin stop, wherein the at least one stop pin limits the angle through which the rotational member may be rotated.

10. The motor steering apparatus of claim 9 wherein the rotational member is a pulley.

11. The motor steering apparatus of claim 10 wherein the pulley comprises:

at least one pin groove configured to communicate with the at least one pin stop to limit the angle through which the pulley may be rotated; and a radial hole configured to receive a set screw to transfer rotational motion of the pulley to the motor.

12. The motor steering apparatus of claim 1, further comprising a motor drop shaft coupled to the rotational member.

13. The motor steering apparatus of claim 12, further comprising a motor coupled to the motor drop shaft.

14. The motor steering apparatus of claim 13, wherein the motor is an electric outboard.

15. The motor steering apparatus of claim 1, wherein the stabilizing member is a first pin and the second stabilizing member is a second pin.

16. The motor steering apparatus of claim 1, wherein the rotational member is a pulley.

17. The motor steering apparatus of claim 1, wherein each of the peg linkage and the second peg linkage comprises a cord.

18. The motor steering apparatus of claim 1, wherein each of the stabilizing spring and the second stabilizing spring comprises a compression spring.

19. The motor steering apparatus of claim 1, wherein the first end of the cable comprises a threaded stud that couples with the stabilizing member, and wherein the second end of the cable comprises a second threaded stud that couples with the second stabilizing member.

20. The motor steering apparatus of claim 19, wherein the cable comprises a catch and the rotational member comprises a recess, and wherein the cable is coupled with the rotational member by coupling the catch with the recess.

* * * * *